US010334951B2

(12) United States Patent
Robertson et al.

(10) Patent No.: US 10,334,951 B2
(45) Date of Patent: Jul. 2, 2019

(54) ADJUSTABLE FURNITURE

(71) Applicant: INTEGRATED FURNITURE TECHNOLOGIES LIMITED, Aylesbury, Buckinghamshire (GB)

(72) Inventors: Dale Robertson, Aylesbury (GB); Paul Brown, Chorley (GB)

(73) Assignee: DEWERTOKIN GMBH, Kirchlengern (DE)

( * ) Notice: Subject to any disclaimer, the term of this patent is extended or adjusted under 35 U.S.C. 154(b) by 0 days.

(21) Appl. No.: 15/535,085

(22) PCT Filed: Dec. 1, 2015

(86) PCT No.: PCT/GB2015/000315
§ 371 (c)(1),
(2) Date: Jun. 12, 2017

(87) PCT Pub. No.: WO2016/092249
PCT Pub. Date: Jun. 16, 2016

(65) Prior Publication Data

US 2017/0360202 A1 Dec. 21, 2017

(30) Foreign Application Priority Data

Dec. 11, 2014 (GB) ..... 1422032
Dec. 11, 2014 (GB) ..... 1422034

(51) Int. Cl.
*A47C 1/035* (2006.01)
*A47C 1/032* (2006.01)
(Continued)

(52) U.S. Cl.
CPC ..... *A47C 1/03294* (2013.01); *A47C 1/0242* (2013.01); *A47C 1/035* (2013.01);
(Continued)

(58) Field of Classification Search
CPC ... A47C 1/03294; A47C 1/0244; A47C 1/036; A47C 1/0352; A47C 20/041; A47C 20/08; A61G 7/015
(Continued)

(56) References Cited

U.S. PATENT DOCUMENTS 139,493 A 6/1873 Bray
638,466 A 12/1899 Kelly
(Continued)

FOREIGN PATENT DOCUMENTS

CA 851 402 9/1970
CA 851402 9/1970
(Continued)

OTHER PUBLICATIONS

GB 1521139.4, Examination Report dated Feb. 5, 2018, 4 pages—English.
(Continued)

*Primary Examiner* — Mark R Wendell
(74) *Attorney, Agent, or Firm* — Andrew F. Young, Esq.; Lackenbach Siegel, LLP

(57) ABSTRACT

The invention provides an article of adjustable furniture (10), preferably an adjustable chair or bed, comprising a floor standing base section (16), adjustable seat (18), backrest (20) and headrest (130) sections and actuator means (100) for moving the backrest and headrest sections. The seat section is movably mounted with respect to the base section. The backrest is movably mounted with respect to the seat section and the headrest is movably mounted with respect to the backrest section. The actuator means includes a single actuator (102) for co-ordinated movement of the adjustable backrest and headrest sections for selectively altering the configuration of the article of furniture. The actuator has a first range of movement for moving the
(Continued)

headrest with respect to the backrest, and a second range of movement for moving the backrest with respect to the seat section to provide a recliner function. The invention also provides an article of adjustable furniture comprising a backrest (20) and an adjustable headrest (130) pivotally mounted with respect to the backrest, actuator means (100) for moving the headrest between raised and lowered positions, and guide means arranged between the headrest and the backrest for rotating the headrest with respect to the backrest as it moves between said raised and lowered positions. The guide means includes first (138) and second (140) guides, each associated with one of the backrest and the headrest and having at least one follower (142, 144) associated with the other of the backrest and headrest. The first and second guides are inclined with respect to each other such that a turning moment is generated on the headrest when the headrest is raised or lowered.

39 Claims, 16 Drawing Sheets

(51) Int. Cl.
*A47C 1/024* (2006.01)
*A47C 1/036* (2006.01)
*A47C 1/0355* (2013.01)

(52) U.S. Cl.
CPC ..... *A47C 1/036* (2013.01); *A47C 1/0355* (2013.01); *A47C 1/0352* (2013.01)

(58) Field of Classification Search
USPC ..... 297/343; 5/613, 617, 618
See application file for complete search history.

(56) References Cited

U.S. PATENT DOCUMENTS 912,214 A 2/1909 Ward
1,238,078 A 8/1917 Ault
1,414,637 A 5/1922 Gell
2,859,797 A 11/1958 Mitchelson
2,954,072 A 9/1960 Fossati
2,989,341 A 6/1961 Schliephacke
3,036,862 A 5/1962 Beierbach et al.
3,086,814 A 4/1963 Fletcher
3,121,589 A 2/1964 Schliephacke
3,202,453 A 8/1965 Richards
3,369,767 A 2/1968 Greenfield
3,797,050 A 3/1974 Benot et al.
3,847,430 A 11/1974 Fletcher
3,873,152 A 3/1975 Garas
4,202,062 A 5/1980 Marcyan
4,547,017 A 10/1985 Lescure
4,635,999 A 1/1987 Simpson
4,691,961 A * 9/1987 Rogers, Jr. ..... A47C 1/036 297/396
4,840,429 A 6/1989 Stockl
4,970,737 A 11/1990 Sagel
4,996,731 A 3/1991 Kruyt
5,112,109 A 5/1992 Takada et al.
5,246,266 A 9/1993 Ostergaard
5,346,277 A * 9/1994 Holobaugh ..... A47C 1/037 297/396
5,625,913 A 5/1997 Singleton
5,640,730 A 6/1997 Godette
5,785,384 A 7/1998 Sagstuen
5,819,345 A 10/1998 Basgall
5,897,462 A 4/1999 St. Germain
6,059,364 A 5/2000 Dryburgh et al.
6,101,648 A 8/2000 Sommerfeld et al.
6,568,755 B1 5/2003 Groening
6,641,214 B2 11/2003 Veneruso
6,695,378 B2 * 2/2004 Hanagan ..... B60N 2/3031 296/65.01
6,739,661 B1 5/2004 Dukes
7,201,438 B2 * 4/2007 Reinsch ..... A47C 1/036 297/61
7,219,958 B2 5/2007 Yamazaki et al.
7,390,060 B2 6/2008 Kristen
7,445,279 B2 11/2008 Crum
7,641,277 B2 1/2010 Lawson et al.
7,703,851 B2 4/2010 Nakaya et al.
7,997,654 B2 8/2011 Ferry et al.
8,303,036 B2 11/2012 Hankinson et al.
8,403,415 B2 3/2013 Lawson
8,424,964 B2 4/2013 Campbell et al.
8,534,758 B2 9/2013 Rivera
8,955,178 B2 * 2/2015 Robertson ..... A47C 20/041 5/613
9,155,388 B2 10/2015 Robertson
9,808,385 B2 11/2017 Robertson
10,004,334 B2 6/2018 Robertson
2002/0060483 A1 5/2002 Yoshida et al.
2002/0152552 A1 * 10/2002 Dewert ..... A47C 20/041 5/618
2002/0174487 A1 11/2002 Kramer et al.
2003/0172455 A1 9/2003 Roma et al.
2004/0155504 A1 8/2004 Tada
2005/0210588 A1 9/2005 Loewenthal
2007/0120409 A1 5/2007 Leeds
2007/0158980 A1 7/2007 LaPointe et al.
2008/0150329 A1 6/2008 Lawson
2009/0044339 A1 2/2009 Morin et al.
2009/0178201 A1 7/2009 Lujan et al.
2011/0248530 A1 10/2011 Sartisohn
2014/0103688 A1 4/2014 Wilson
2014/0312660 A1 * 10/2014 Natuzzi ..... A47C 1/0342 297/61
2017/0347797 A1 * 12/2017 Robertson ..... A47C 1/036

FOREIGN PATENT DOCUMENTS

CH 597799 10/1975
CN 202314169 7/2012
DE 3347255 7/1985
DE 029715343 1/1998
DE 2 510 584 6/1999
DE 010152227 5/2003
DE 20 2007 009 068 12/2007
DE 10 2007 024 218 11/2008
DE 102007024218 11/2008
DE 10 2007 049 118 2/2009
DE 20 2013 004 428 10/2013
EP 0781518 12/1996
EP 0865960 3/1998
EP 1 537 805 6/2005
EP 1 621 175 2/2006
EP 2 524 623 11/2012
GB 0101239 8/1916
GB 0329834 5/1930
GB 0414464 8/1934
GB 0775679 5/1957
GB 2 085 719 8/1980
GB 2227932 8/1990
GB 2418846 12/2006
GB 2472920 2/2011
GB 2486335 6/2012
GB 2472920 2/2014
GB 191322022 8/2014
GB 2520430 11/2015
JP 36-13946 5/1936
JP 08-173263 7/1996
JP 08-308680 11/1996
JP 11-244096 9/1999
JP 2003-144262 5/2003
WO WO2016/058949 4/1916
WO WO 96/29970 10/1996
WO WO 2005/051128 6/2005
WO WO 2005/107533 11/2005
WO WO 2006/023447 3/2006

(56) References Cited

FOREIGN PATENT DOCUMENTS

| | | |
|---|---|---|
| WO | WO 2007/124067 | 11/2007 |
| WO | WO 2008/129565 | 10/2008 |
| WO | WO 2008/132481 | 11/2008 |
| WO | WO/2011/021002 | 2/2011 |
| WO | WO 2011/021002 | 2/2011 |
| WO | WO2011/048384 | 4/2011 |
| WO | WO 2012/032305 | 3/2012 |
| WO | WO 2012/099061 | 7/2012 |
| WO | WO 2013/061259 | 5/2013 |
| WO | WO2013/061259 | 5/2013 |
| WO | WO 2014/183112 | 11/2014 |
| WO | WO 201/5011432 | 9/2015 |

OTHER PUBLICATIONS

GB1521143.6, Examination Report dated Feb. 5, 2018, 6 pages—English.
PCT/GB2015/000315, International Search Report and Written Opinion, dated Jul. 3, 2016, 12 pages—English.
GB 1316684.8, International Search Report and Written Opinion, 7 pages—English.
PCT/GB2015/000315, International Search Report and Written Opinion, dated Jul. 3, 2016, 9 pages—English.
GB1422032.1, Search Report dated Apr. 29, 2015, 2 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
Pat. No. GB 1417108.6, Combined Search and Examination Report dated Mar. 26, 2015, 7 pages—English.
EasyCliner® wood-to-the-floor recliner mechanism. 1 page, HomeFurnitureComponents.com, Apr. 10, 2015.
GB1313002.6, Search Report dated Jan. 21, 2014, 4 pages.
PCT/GB2014/000274. Written Opinion dated Jan. 21, 2014. 5 pages.
U.S. Appl. No. 13/390,985, filed Feb. 17, 2012, Office Action dated Jan. 7, 2015, 20 pages.
PCT/GB2010/001565 International Search Report dated Apr. 12, 2011, 6 pages—English.
EP Appln. No. 08 737 140.7, European Search Report dated Jan. 6, 2018, 4 pages—Englsih.
PCT/GB2017/051732, International Preliminary Report on Patentability and Written Opinion, dated Dec. 18, 2018, 8 pages—English.

* cited by examiner

ADJUSTABLE FURNITURE

CROSS REFERENCE TO RELATED APPLICATIONS

This application relates to a § 371 national phase to Ser. PCT/GB2015/000315 filed Dec. 1, 2015, the entire contents of which are incorporated herein by reference which in turn claims priority to both GB Ser No. 1422032.1 Filed Dec. 11, 2014 and GB 1422034.7 filed Dec. 11, 2014.

FIGURE SELECTED FOR PUBLICATION

FIG. 5

FIELD OF THE INVENTION

This invention relates to adjustable furniture, for example chairs, beds or the like in which one furniture component can be moved relative to another. The adjustment may be powered, using electrical motors or the like, or manual.

BACKGROUND OF THE INVENTION

Adjustable chairs are known in which the angle of the backrest can be altered to provide a recline function and/or in which a moveable footrest can be independently moved to a deployed position for lower limb support. Recliner chairs may be manual or powered. In the latter, adjustment is usually achieved by one or more powered actuators, typically electric motors. Some motorised chairs have the ability to lift the chair, or at least the seat section of the chair, to assist the occupant from a seated to a standing position. So called 'zero-wall' recliner chairs have been developed which enable a recliner chair to be positioned with the backrest in close proximity to a wall or other structure and allow the backrest to be reclined without interference with the wall. This can be achieved with the backrest movement being coordinated with the movement of the seat and associated structure the backrest is pivotally connected to. Adjustable beds are also known in which a head support and backrest section of the bed can be moved to adjust the inclination of the backrest.

Various arrangements of adjustable furniture are described in WO2011/021002 including a recliner chair having a floor standing base section, an intermediate support section that carries the seat, a backrest and a footrest. The chair has zero wall functionality. As the backrest reclines the intermediate support and seat section move forwards and upwards with respect to the base section. Co-ordinated movement of the various adjustable sections is achieved by means of a series of guides, pivots, rollers, linkages and the like. The recliner chair may be powered or manual. In powered arrangements the recliner chair may include an electrical linear actuator for moving the backrest and a second electrical linear actuator for independently moving the footrest.

Contemporary furniture concepts include deep back sofas and chairs where the backrest is set back a significant distance from the front of the sofa or chair to provide a greater seat depth. Low back concepts are also common in contemporary furniture design. Deep back and/or low back designs may include an additional adjustable section in the form of a headrest or neckrest for supporting the occupant more comfortably when the furniture is reclined. In the context of the present invention the terms headrest and neckrest are used interchangeably and do not specifically denote support exclusively of the head or neck of the occupant but either or both. Similarly where reference is made to "chair" it is to be understood that this not only includes reference to single seat chairs but also multiple seat sofas, other forms of seating that may not be considered to be a chair as such, and chaise lounge or the like.

ASPECTS AND SUMMARY OF THE INVENTION

According to the present invention there is provided an article of adjustable furniture comprising a floor standing base section, adjustable seat, backrest and headrest sections and actuator means for moving said backrest and headrest sections, the seat section being movably mounted with respect to the base section, the backrest being movably mounted with respect to the seat section and the headrest being movably mounted with respect to the backrest section, characterised in that said actuator means includes a single actuator for co-ordinated movement of the adjustable backrest and headrest sections for selectively altering the configuration of the said article of furniture.

The above aspect of the present invention is particularly advantageous as it employs only a single actuator, such as a powered motor or gas strut or spring, for both the adjustable headrest and the recline function of the article of furniture. This can reduce the cost of the furniture significantly compared with arrangements where dedicated actuators are required for recline and headrest adjustment functions. Thus, a significant saving in manufacturing costs can be achieved which can afford wider appeal in the marketplace for adjustable furniture types having an adjustable headrest. In addition, the above aspect of the invention provides for more simple mechanical construction since unnecessary duplication of component parts is readily avoided.

Preferably, the actuator has a first range of movement for moving the headrest section with respect to the backrest section, and a second range of movement for moving the backrest with respect to the seat section to provide the backrest with a recline function. In this way the headrest may be moved between stowed and deployed positions independently of the backrest being moved. The headrest may therefore be deployed prior to movement of the backrest and subsequently retracted to its stowed position once the backrest has been returned to its upright position. Thus, it is possible to actuate the headrest independently of the backrest when the backrest is upright, that is to say when the backrest is in its non-reclined position.

The first and second ranges of movement are preferably contiguous. In this way the second range of movement immediately follows the first. Thus, the full range of movement of the actuator can be utilised with an uninterrupted transition between movement of the headrest and movement of the backrest.

In preferred embodiments movement of the actuator in the first range of movement exclusively moves the headrest with respect to the backrest section. Thus, to the observer it may appear that the article of furniture is provided with dedicated actuators for independent sequential movement of the backrest and the headrest.

Preferably, movement of the actuator in the second range of movement causes the backrest to move with respect to the seat section, without further movement of the headrest section with respect to the backrest section. In this way the headrest may be moved exclusively in the first range of movement and the backrest moved in the second range of movement such that the backrest and headrest appear to be under independent sequential control utilising dedicated actuators for the respective movements.

The article of adjustable furniture may further comprise at least one connecting line having a first end fixed in relation to a movable part of the actuator and a second end fixed in relation to the headrest section, whereby movement of the actuator is transmitted to the headrest via the connecting line. In this way the headrest may be moved with respect to the backrest by movement of the actuator in its first range of movement and the associated movement of the connecting line under tension. The connecting line may comprise part of a hoist for extending the headrest when the hoist is raised and lowering the headrest when the hoist is lowered. The connecting line readily enables the actuator to be remotely connected to the headrest and optimally positioned within the article of furniture for both headrest and backrest adjustment.

Preferably, the connecting line comprises a belt, strap, cable, cord, rope or the like. The choice of connecting line may be determined by the requirements of the particular application and is not limited to one of the aforementioned examples of a belt, strap, cable, cord or rope.

The article of adjustable furniture may further comprise a guide cam associated with one of the said seat section and said actuator means and a follower associated with the other of said seat section and said actuator means. In this way the guide cam and follower are interchangeable in the sense that one may be fixed in relation to either the actuator or the seat section and the other in relation to the other of the actuator and seat section. The guide cam and follower provide a convenient and mechanically simple arrangement for defining the first and second ranges of movement and implementing aspects of the present invention.

Preferably, the guide cam is fixed in relation to the seat section and the follower is fixed in relation to a movable part of the actuator means. In certain embodiments it is preferred that the follower is mounted on or in relation to the actuator so that the follower may be moved along the guide cam in the said first and second ranges of movement of the actuator means.

In preferred embodiments the guide cam has a cam profile including a first linear section which defines the first range of movement of the actuator means and a second linear section inclined with respect to the first section which defines the second range of movement.

The cam profile is preferably such that the follower is free to move back and forth along the first section to effect movement of the headrest, with movement of the follower along the second section being constrained by engagement of the follower and the inclined section, which engagement imparts a reaction force between the follower and the inclined section to effect movement of the seat section with respect to the base section and the backrest section with respect to the seat section. Thus, in preferred embodiments where the guide cam is fixed in relation to the seat section, movement of the follower along, or in, the second inclined section effects movement of the seat section with respect to the base. Preferably the actuator is fixed in relation to the base so that the seat section is moved by the direct action of the actuator on the follower acting on the guide cam and thereby the seat section.

In preferred embodiments the follower is mounted in relation to a movable part of the actuator. This may be a moving block or ram part of a linear actuator, for example.

Guide means may be provided between the seat section and the base section for guided movement of the seat section relative to the base section when the backrest section moves about its pivot axis. In this way movement of the seat section relative to the base section is determined by the guide means between those sections.

Preferably, the seat section includes a pair of lateral side panels, and guides of the guide means are provided in or on the side panels. The guides may be provided as respective slots in the side panels of the seat section.

Preferably the guide(s) of the guide means is/are inclined in an equal and opposite direction to the inclination of the said second linear section of the cam profile relative to the first linear section. Thus, as the seat section moves relative to the base section the follower may move horizontally along its direction of travel with respect to the base. This is possible if the inclined section of the cam guide means along which the follower travels is of an equal and opposite inclination to that of the guide means which determine the movement of the seat section relative to the base section. Thus, any upward or downward movement of the seat section relative to the base during back and forth movement, due to the inclination of the guide means between the seat and base, is compensated for exactly by the inclination of the cam guide means fixed relative to the seat section. Thus the follower moves freely along the second section of the cam guide means during movement of the seat section when the seat section is raised and lowered relative to the base section.

In preferred embodiments the seat section moves in a forwards and upwards direction when the backrest is reclined, and in a rearwards and downwards direction when the backrest is raised. This provides for effective counterbalancing of the article of furniture and thereby reduces the operational load on the actuator means when the backrest is moved. The upwards and forwards movement is determined by the upwards and forwards orientation of the guides and compensated for by a downwards inclination of the second section of the cam guide means. In this way the second section of the cam guide means may be considered to be inclined downwards relative to the first section.

The backrest section may be guided for movement by further guide means including at least one guide associated with one of the base section and the backrest section and at least one follower associated with the other of the base section and the back rest section. This arrangement readily enables the pivotal movement of the backrest section to be connected to the movement of the seat section relative to the base section. In this way the article of furniture may readily be provided with so called "zero-wall" functionality in which the article of furniture moves forwards when the backrest is reclined to maintain the same degree of separation between the backrest and an adjacent structure, such as a wall, when the backrest is reclined.

The article of furniture may be an adjustable chair, sofa, chaise lounge, adjustable bed or the like having an adjustable backrest and headrest.

According to a second aspect of the present invention there is provided an article of adjustable furniture comprising a backrest and an adjustable headrest movably mounted with respect to the backrest, actuator means for moving the headrest between raised and lowered positions, and guide means arranged between the headrest and the backrest for rotating the headrest with respect to the backrest as it moves between raised and lowered positions.

An article of adjustable furniture may therefore comprise an adjustable headrest according to the above aspect of the invention having rotational motion, or at least a component thereof, when raised or lowered with respect to the adjustable backrest of the article of furniture. The headrest may therefore be arranged so that it lies substantially flat on the top of the backrest and substantially orthogonal thereto when in its lowered position. When raised the headrest readily provides an effective upwards extension of the backrest for supporting the occupants neck and/or head depending on the exact configuration of the headrest. The rotational motion of the headrest readily enables the low back aesthetic of an article of adjustable furniture to be maintained when the headrest is lowered and provide further support and comfort for the occupant when raised, particularly when the backrest is lowered when further support is required.

Preferably, the guide means includes first and second guides, each guide being associated with one of the backrest and the headrest and having at least one follower associated with the other of the backrest and headrest, and wherein the first and second guides are inclined with respect to each other such that a turning moment is generated on the headrest when the headrest is raised or lowered. In preferred embodiments the guides are associated with the backrest and the followers with the headrest but the present invention contemplates embodiments where this is reversed.

In preferred embodiments the followers of the first and second guides are connected to respective fore and aft pivotal connections on the said headrest such that as the headrest is raised or lowered differential movement of the followers in the direction of the first guide causes the headrest to rotate. The inclination of the guides readily provides for differential movement of the respective followers in the direction of the guides so that differences in movement of the respective followers can be utilised in combination with the pivotal connections to impart a turning moment on the headrest as it moves.

Preferably, the followers follow a convergent path along the respective guides when the headrest is raised and a divergent path along the said guides when the headrest is lowered. The geometry of the guide means between the headrest and backrest can be readily optimised in the available space envelope with this specific arrangement.

Preferably, the first and second guides comprise a slot, grove, track or the like in which the respective followers are located. The followers are preferably slideably mounted in respective guide slots of the first and second guides. The first and second guides are preferably linear so that the followers move linearly in the guides.

In preferred embodiments the backrest comprises a pair of lateral side panels and the first and second guides are provided on or in the respective side panels. This provides a mechanically simple arrangement with the guide means of the above aspect of the invention contained within and adjacent to the lateral sides of the headrest. The side panels provide structural support for the guides and support operational loads acting on the headrest and substantially reduce lateral loading and twisting of the headrest when raised.

The guide means preferably further comprises a third guide between the followers of the first and second guides for maintaining a pre-determined spatial relationship between the said first and second guide followers as the headrest is moved. The third guide means readily enables the respective first and second followers to move in predetermined convergent or divergent paths in a co-ordinated and connected manner for actuation of the headrest between its lowered and raised positions.

The third guide is preferably fixed in relation to one of the first or second guide followers, and a respective follower of the third guide is mounted in relation to the other of the first or second guide followers. In this way the motion of the first and second followers is linked so that they move in unison along their respective guides without mechanical interference.

Preferably, third guide is curved or comprises at least one curved section. This accommodates or compensates for the convergent direction of the guide slots.

In preferred embodiments the actuator means comprises an actuator and a hoist having a first end connected and fixed in relation to the follower of the first guide and a second end fixed in relation to a moving part of the actuator. In this way the hoist may act directly on the follower of the first guide so that the follower of the second guide follows the motion of the first. The hoist may be suitably arranged so that the actuator is positioned remotely of the hoist, or at least remote from the backrest.

The hoist preferably comprises a flexible connection line such as a belt, strap, cable, rope or the like. This enables the actuator force to be transmitted remotely by tension in the connection line. The actuator may provide a drive force in one direction only, for example, for raising the headrest via tension in the connection line. The connection line may then permit the headrest to be lowered under gravity when tension in the line is relaxed by movement of the actuator in the opposite direction.

Preferably, the flexible connection line passes over and engages an engagement element fixed in relation to a seat section of the article of furniture, This readily enables the direction of the connection line to be turned so that it tension in the line acts in the desired direction.

The actuator means has a first range of movement for pivotally moving the headrest section with respect to the backrest section, and a second range of movement for pivotally moving the backrest with respect to a seat section to provide the backrest with a recliner function. Preferably, the said first and second ranges of movement are contiguous. Movement of the actuator means in the said first range of movement exclusively moves the headrest with respect to the backrest section. Movement of the actuator in the second range of movement causes the backrest to move with respect to the seat section without further movement of said headrest section with respect to the said backrest section.

In preferred embodiments further movement of the headrest section is prevented by abutment of the followers and the end of the respective first and second guides. Thus, when the followers reach the end of their travel in the respective guides further movement is prevent by abutment with the end of the respective guides. In this way the travel of the actuator can be limited to correspond with the extent of travel of the followers in or on the respective guides.

In preferred embodiments the article of furniture is an adjustable chair, sofa, bed or the like. Thus, the present invention contemplates all types of adjustable furniture having an adjustable backrest and adjustable headrest.

There is a requirement, therefore, for an improved support arrangement for adjustable items of furniture, in particular a support arrangement which is mechanically less complex, less heavy and less costly than hitherto known arrangements.

The present invention will now be more particularly described, by way of example only with reference to the accompanying drawings, in which:

DETAILED DESCRIPTION OF THE PREFERRED EMBODIMENTS

Figure 1:
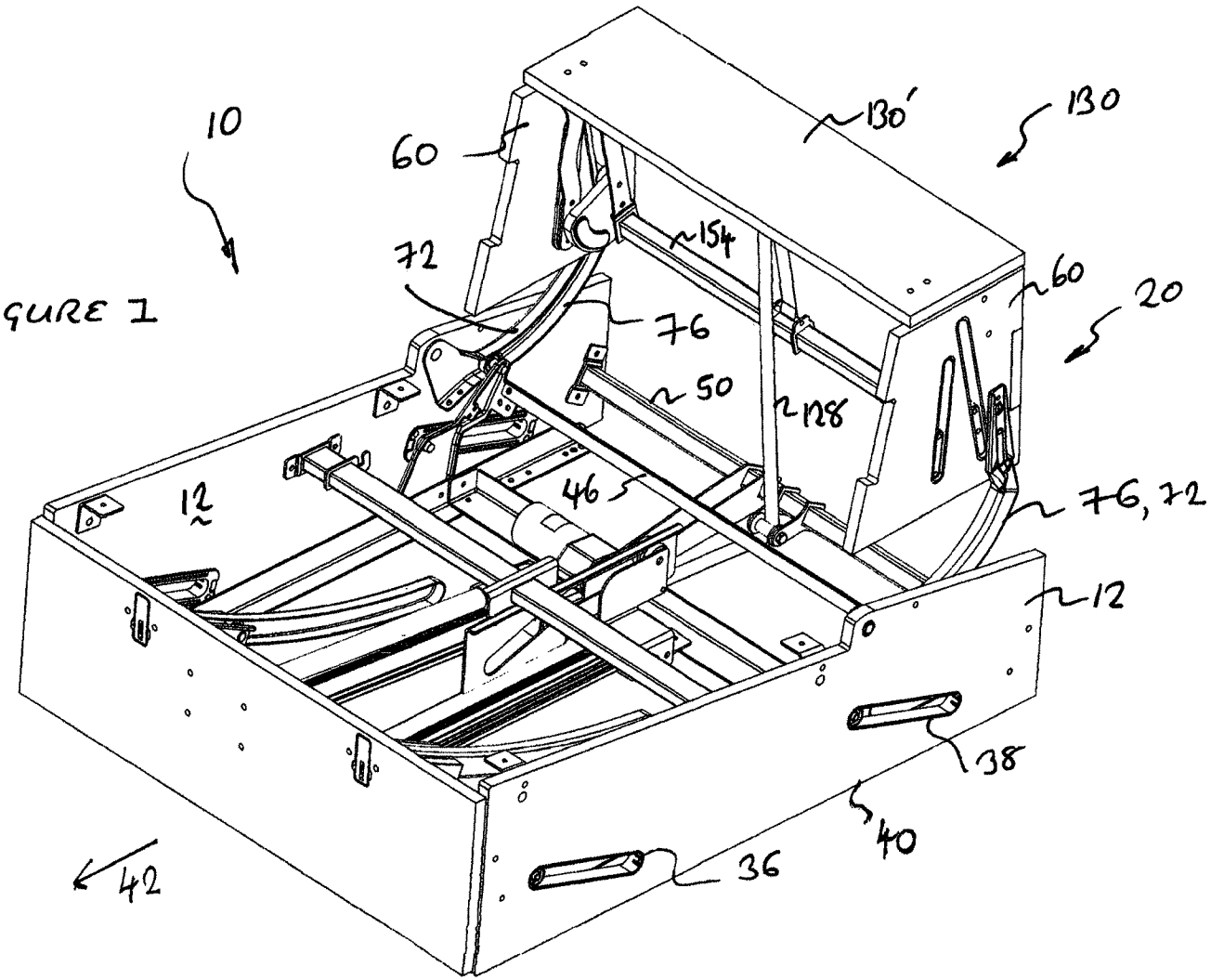
FIG. 1 is a perspective view from above of a frame and operating mechanism of a recliner chair according to an embodiment of the present invention, with the chair in an upright configuration.

Referring now to FIGS. 1-16 which show the structural arrangement and moving parts of a recliner chair arrangement according to an embodiment of the present invention. The recliner chair illustrated is similar to but not the same as that described in WO2011/021002, the contents of which are incorporated herein by reference.

In the drawings, FIGS. 1 to 6 are perspective views of the structural frame and operating mechanism of a recliner chair 10 according to an embodiment of the present invention. It is to be understood that the frame constitutes the frame of a recliner chair before the upholstery is added. The frame construction principally comprises metal components and board material of the type typically used in the furniture industry, for example MDF or engineering board which is readily machineable on a CNC router or the like.

Figure 5:
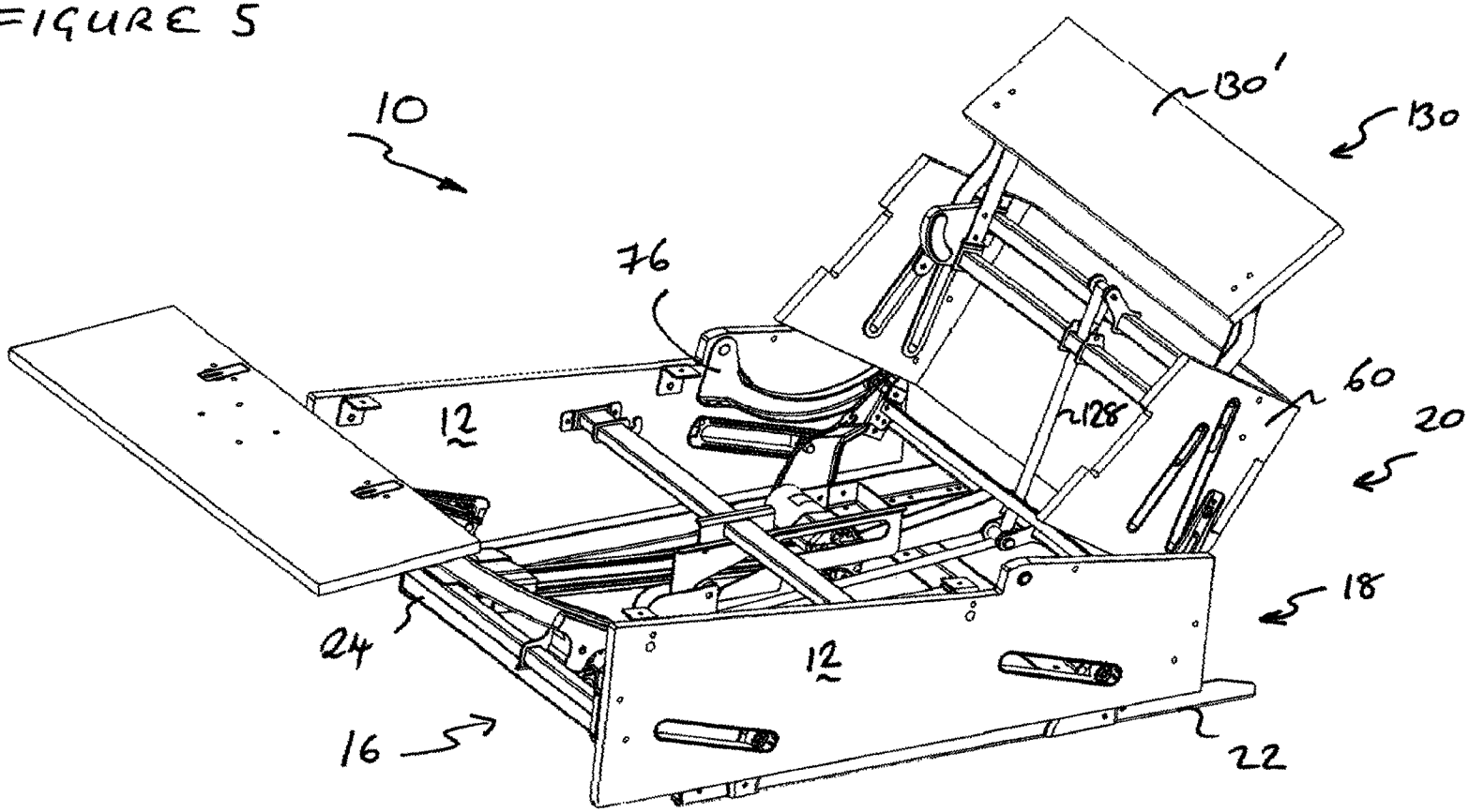
FIG. 5 is a view of the frame and operating mechanism of the chair of FIG. 1 similar to the configuration of FIG. 4 with the footrest board extended.
Figure 6:
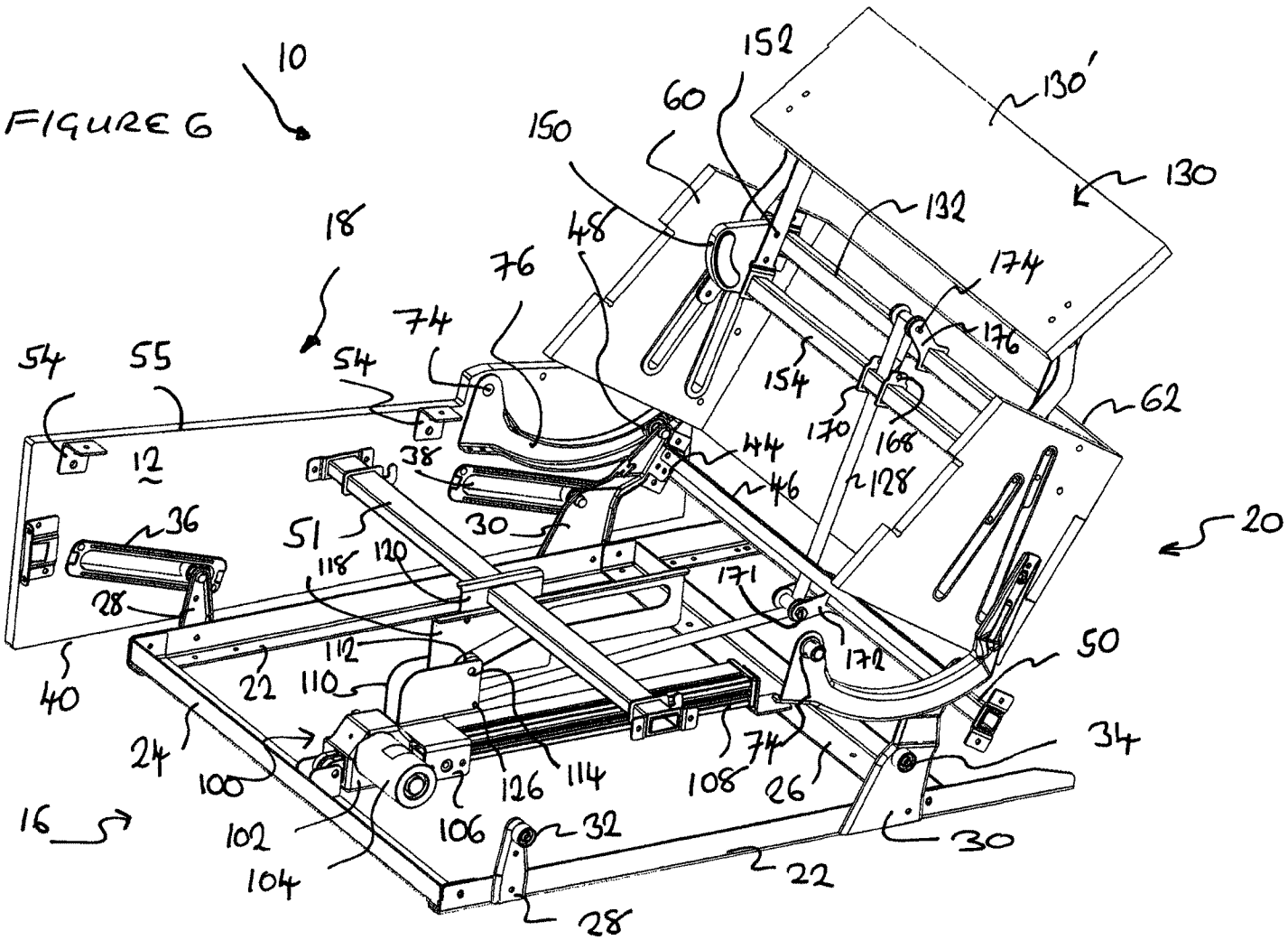
FIG. 6 is a detailed view of the frame and operating mechanism of the chair of FIG. 1, in the reclined configuration of FIG. 4, with many of the components parts, including the footrest, omitted from the drawing.
Figure 7:
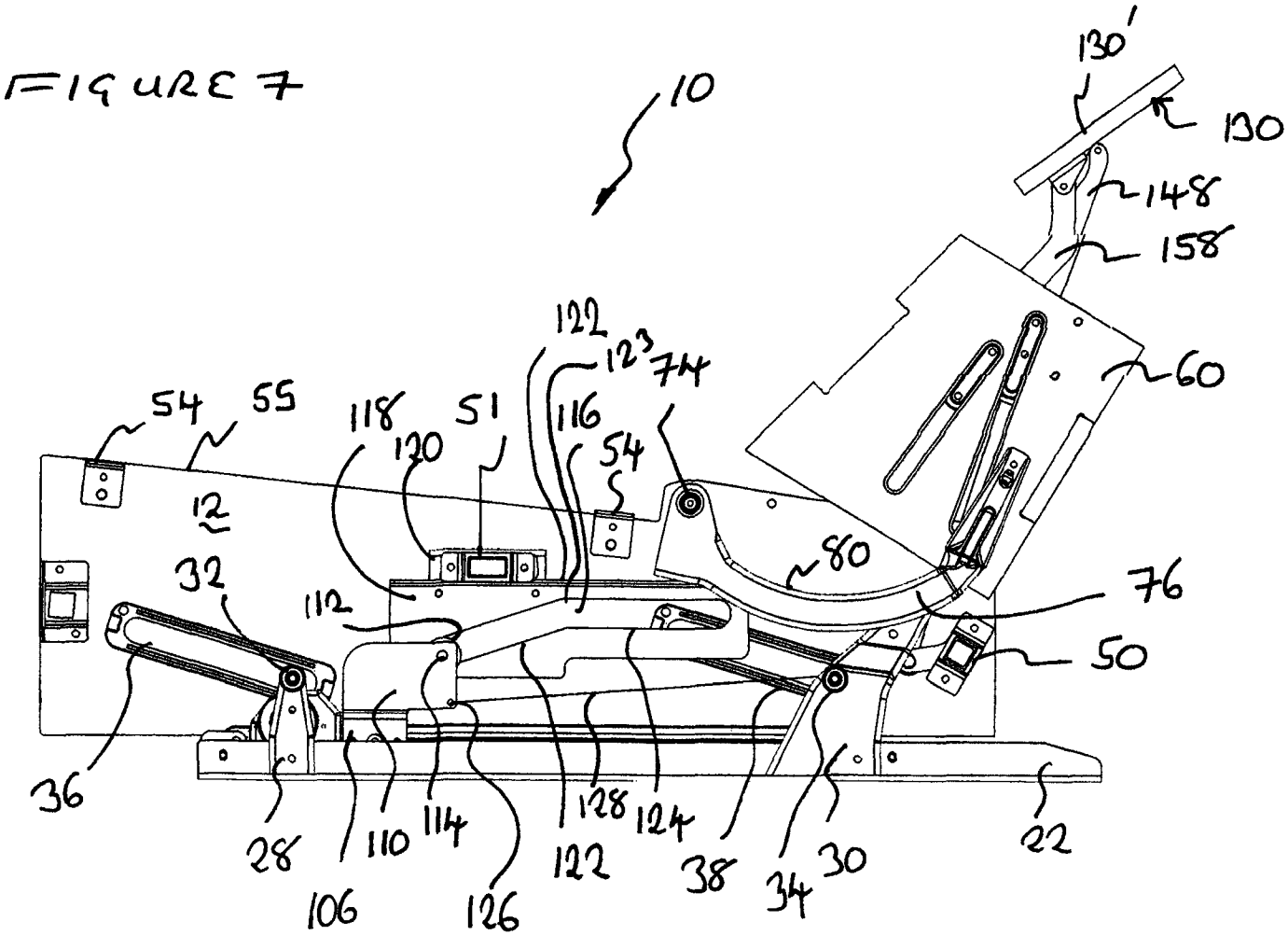
FIG. 7 is a detailed side view of the chair of FIG. 1 stripped of the same component parts as in FIG. 6.
Figure 8:
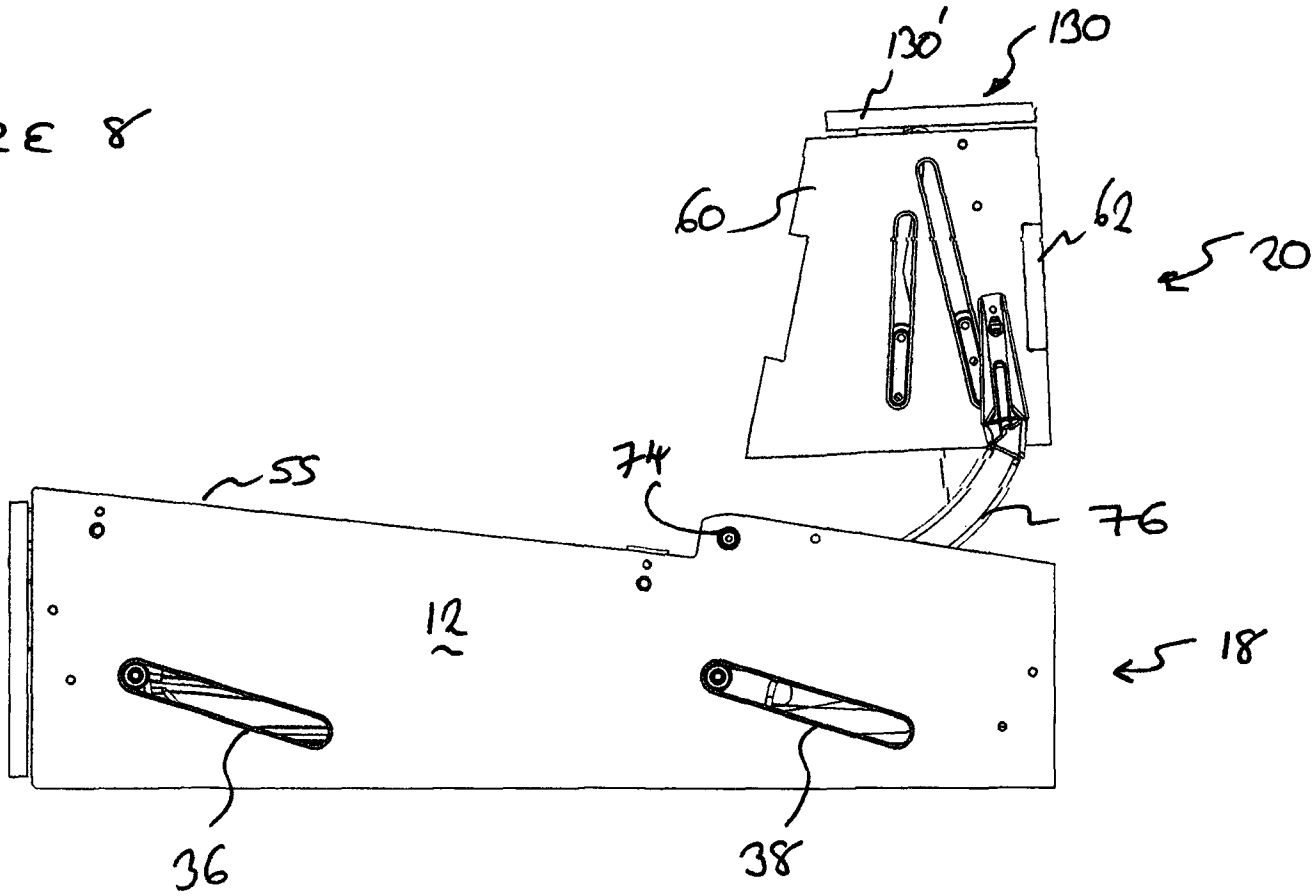
FIG. 8 is a side view of the chair of FIG. 1 shown in the upright configuration of FIG. 1.
Figure 9:
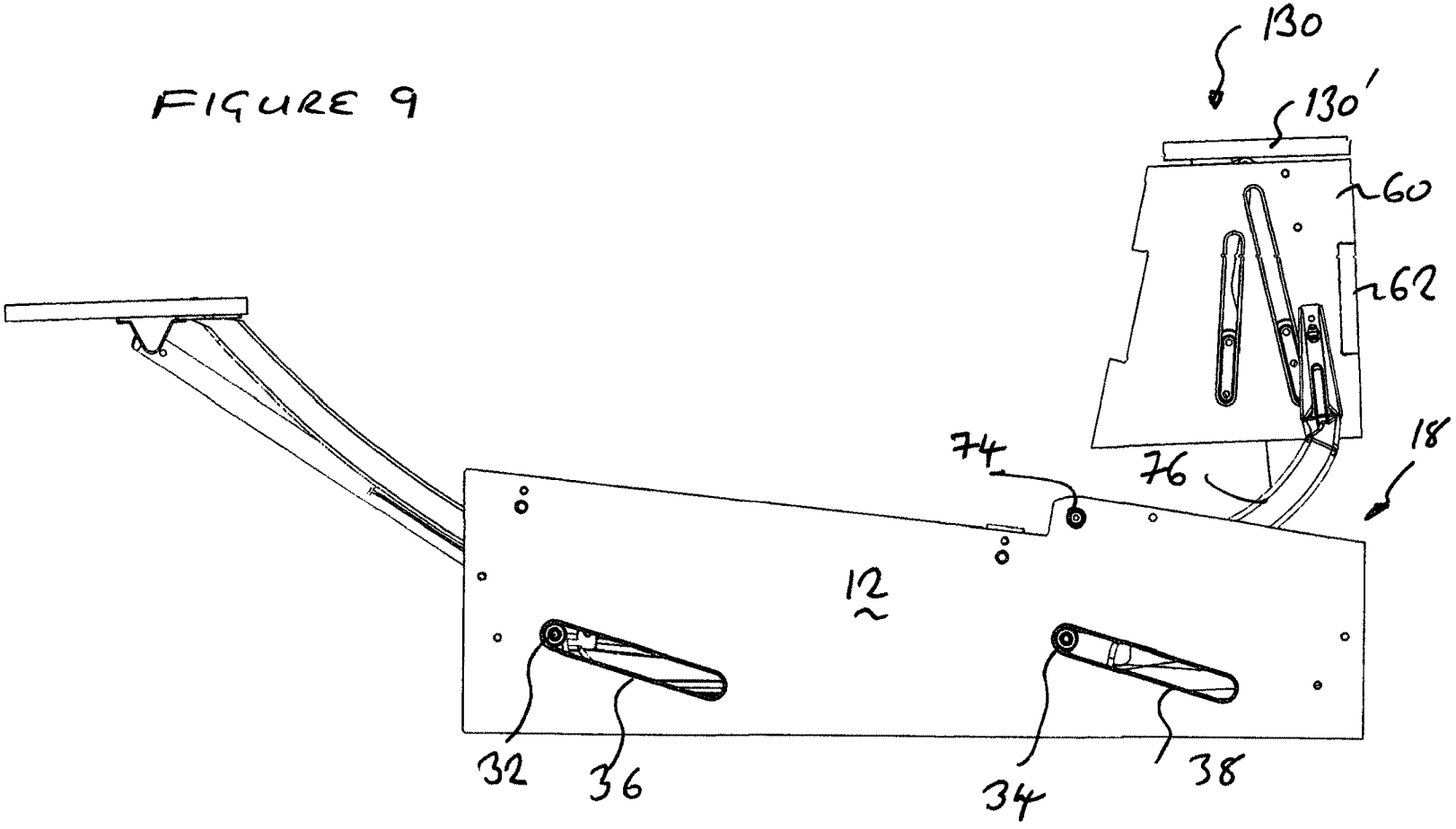
FIG. 9 is a side view of the chair of FIG. 1 shown in the upright configuration of FIG. 1 with the footrest extended.
Figure 10:
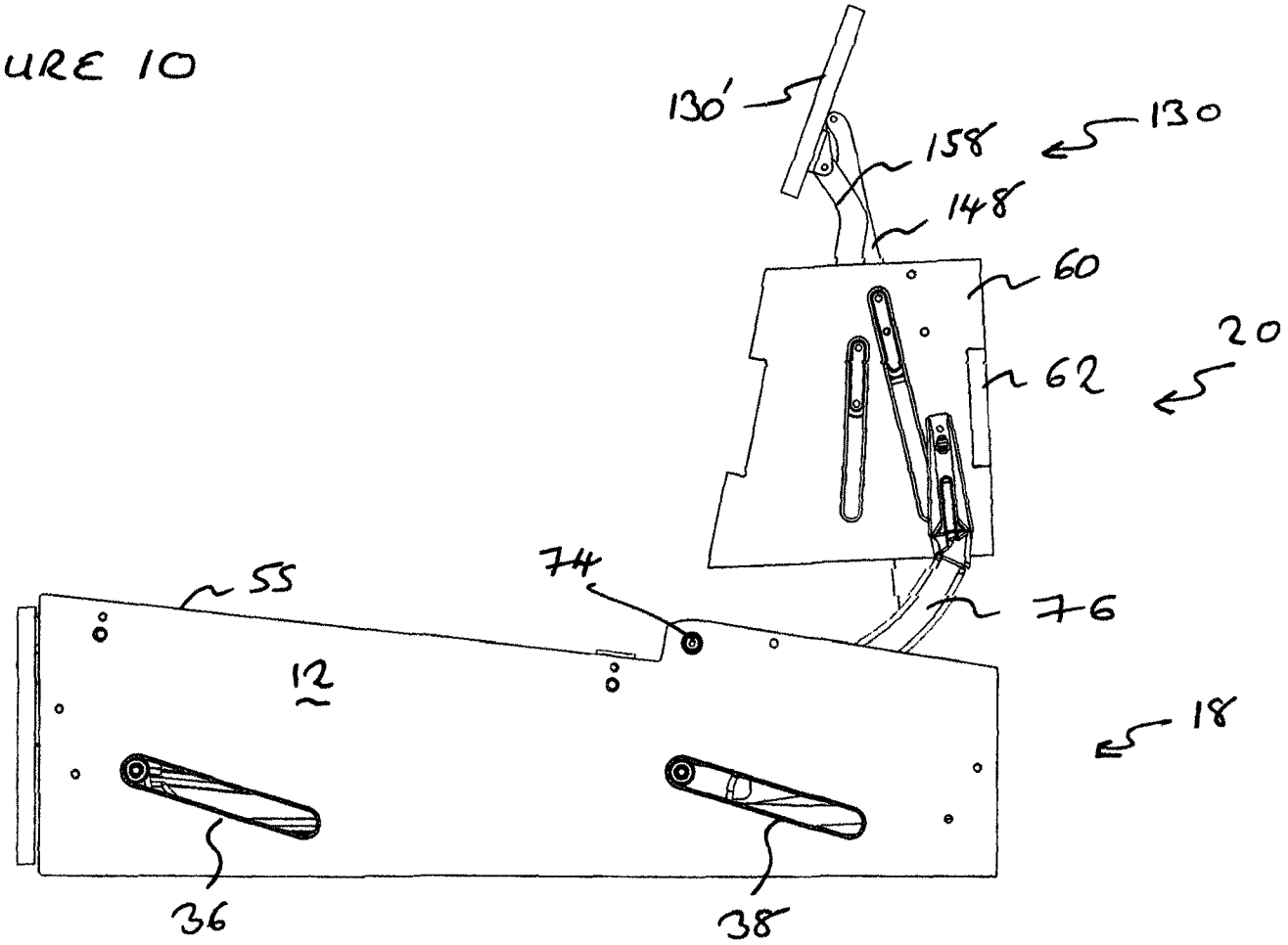
FIG. 10 is a side view of the chair of FIG. 1 shown in the upright configuration of FIG. 1 with the headrest extended.
Figure 11:
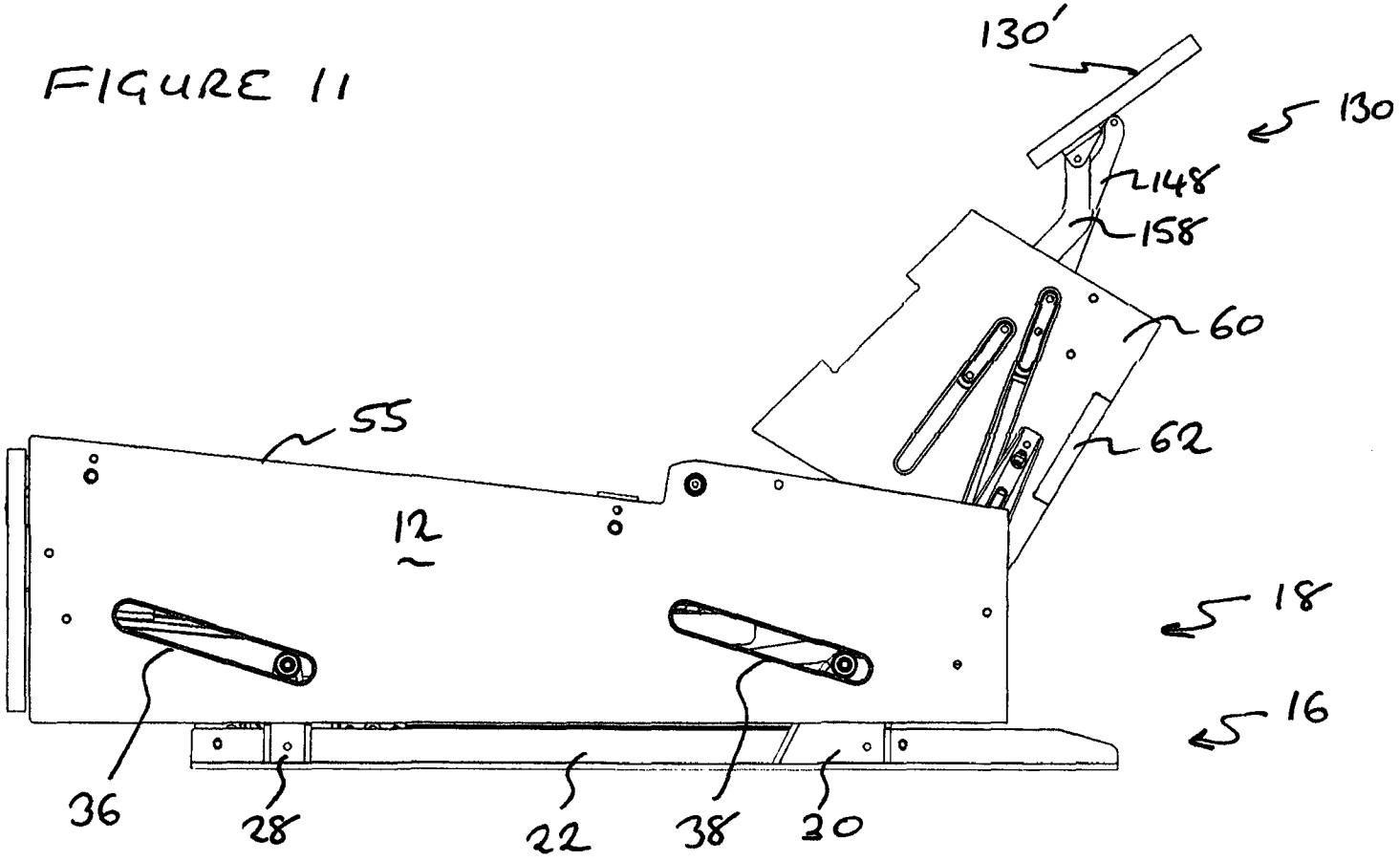
FIG. 11 is a side view of the chair of FIG. 1 shown in the reclined configuration of FIG. 4 with the headrest extended.
Figure 12:
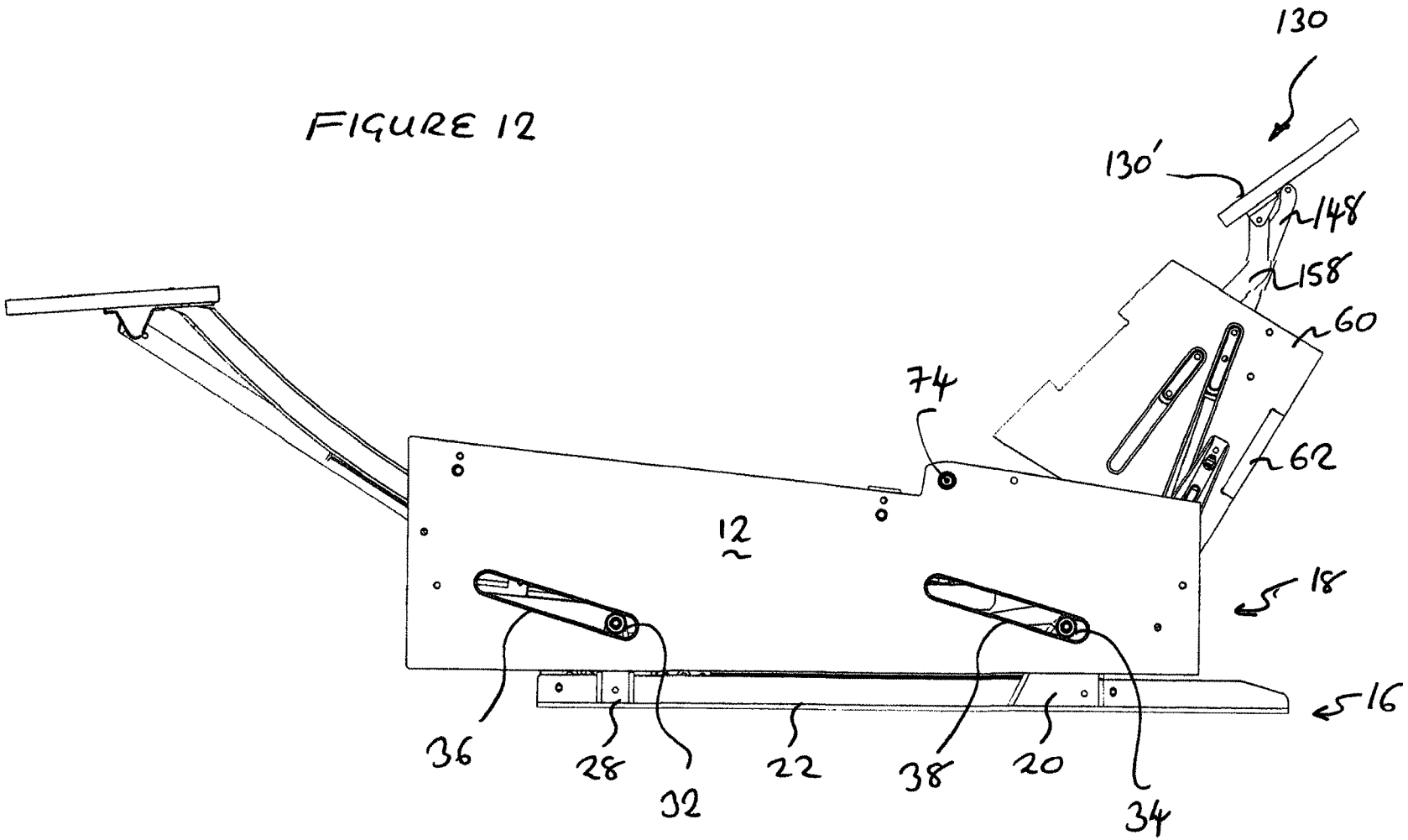
FIG. 12 is a side view of the chair of FIG. 1 shown in the reclined configuration of FIG. 5 with the headrest and footrest extended.
Figure 13:
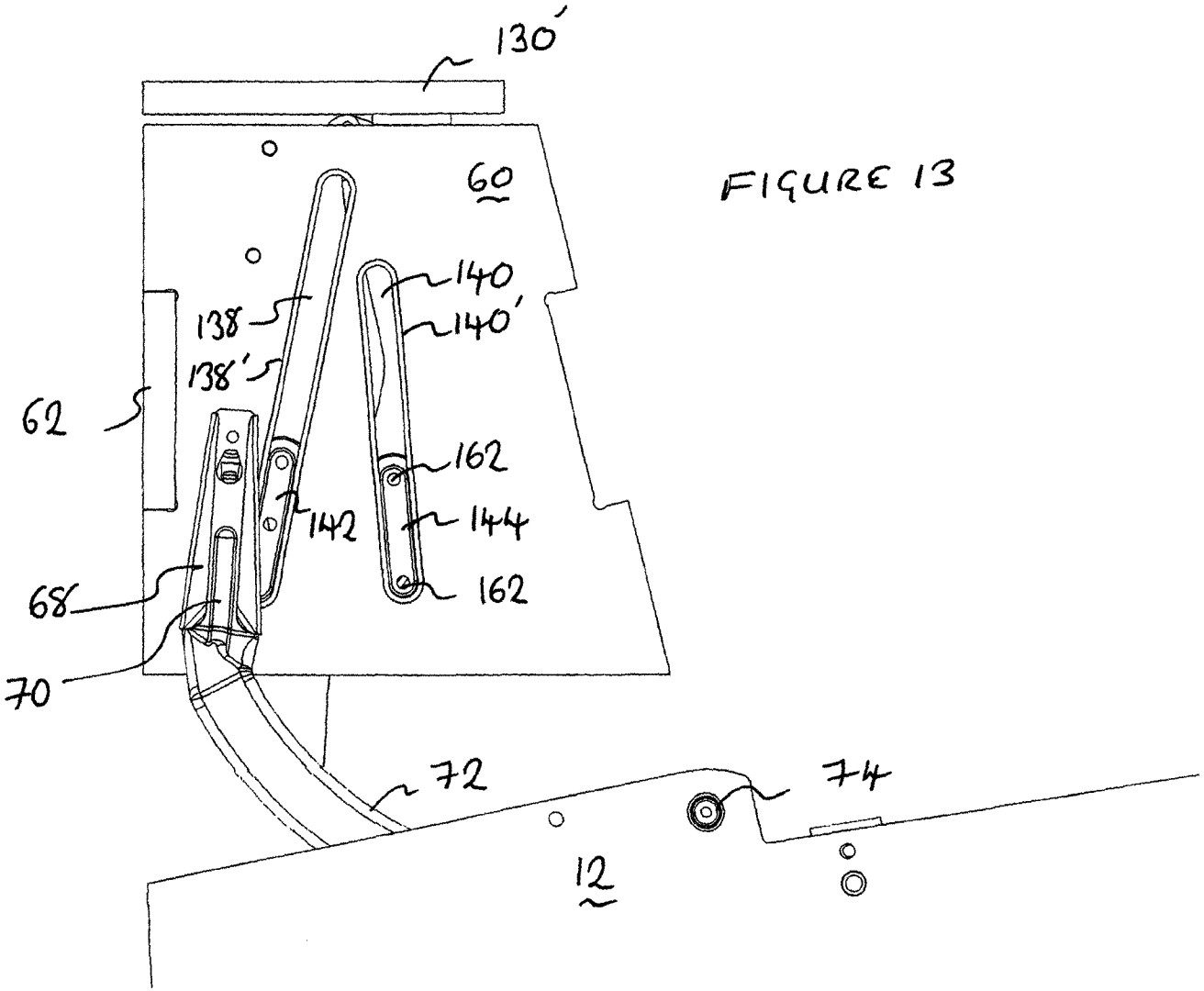
FIG. 13 is an enlarged side view of the backrest and headrest area of the chair of FIG. 1, shown in the upright configuration of FIG. 1.
Figure 14:
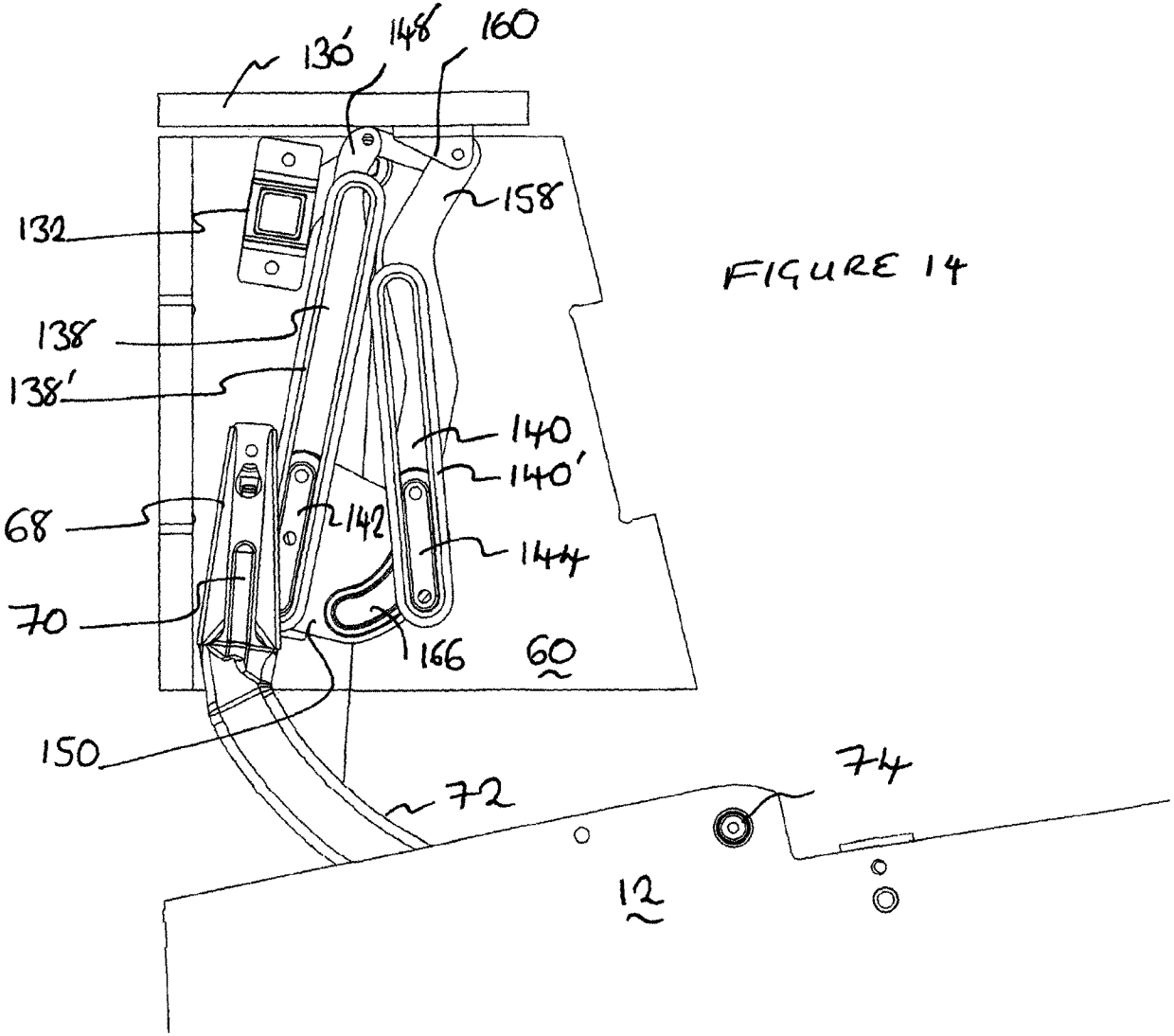
FIG. 14 is an enlarged side view similar to FIG. 13 of the backrest and headrest area of the chair of FIG. 1, with a side panel of the backrest omitted from the drawing.
Figure 15:
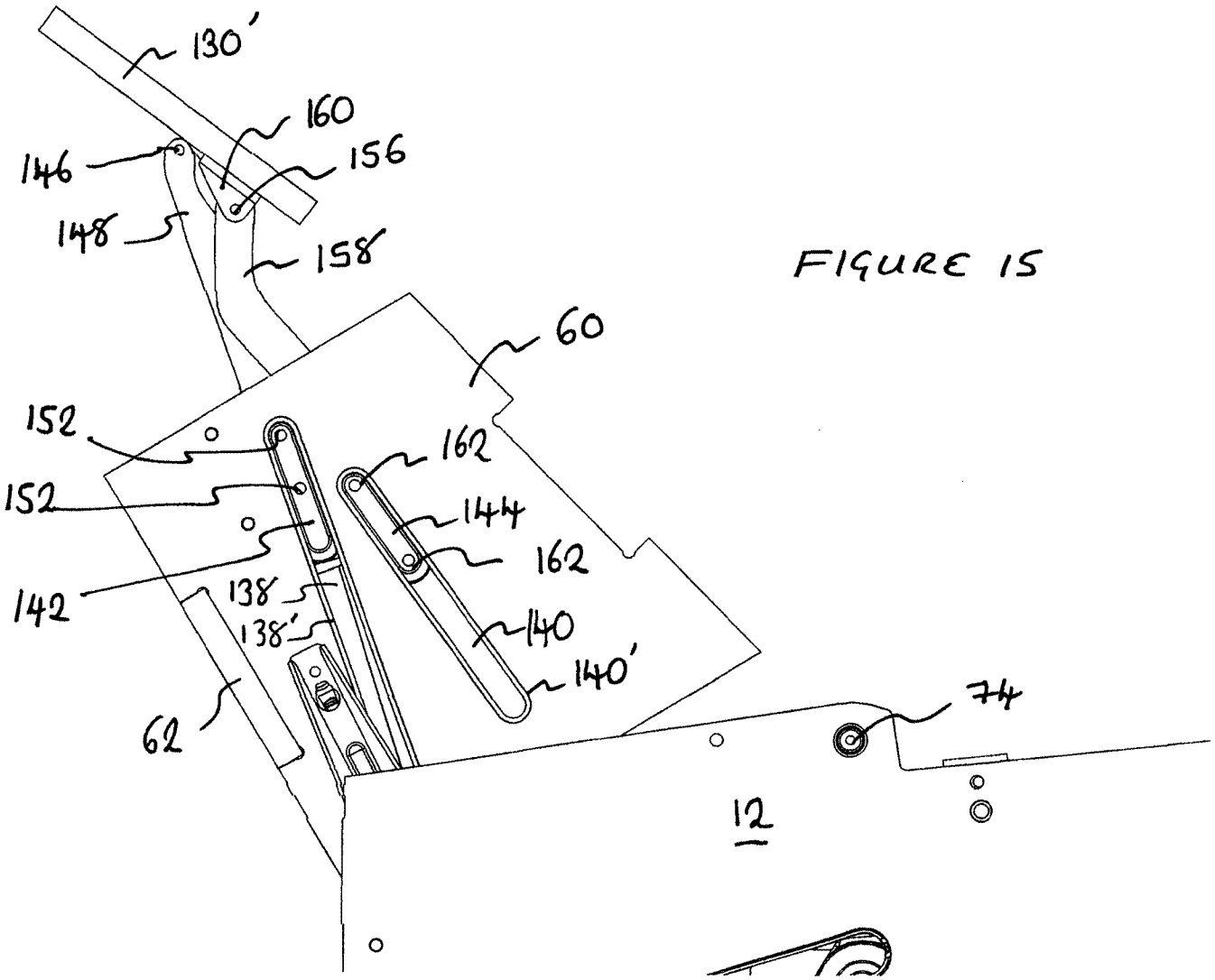
FIG. 15 is an enlarged side view of the backrest and headrest area of the chair of FIG. 1, shown with the backrest reclined and the headrest raised, as in FIG. 4.
Figure 16:
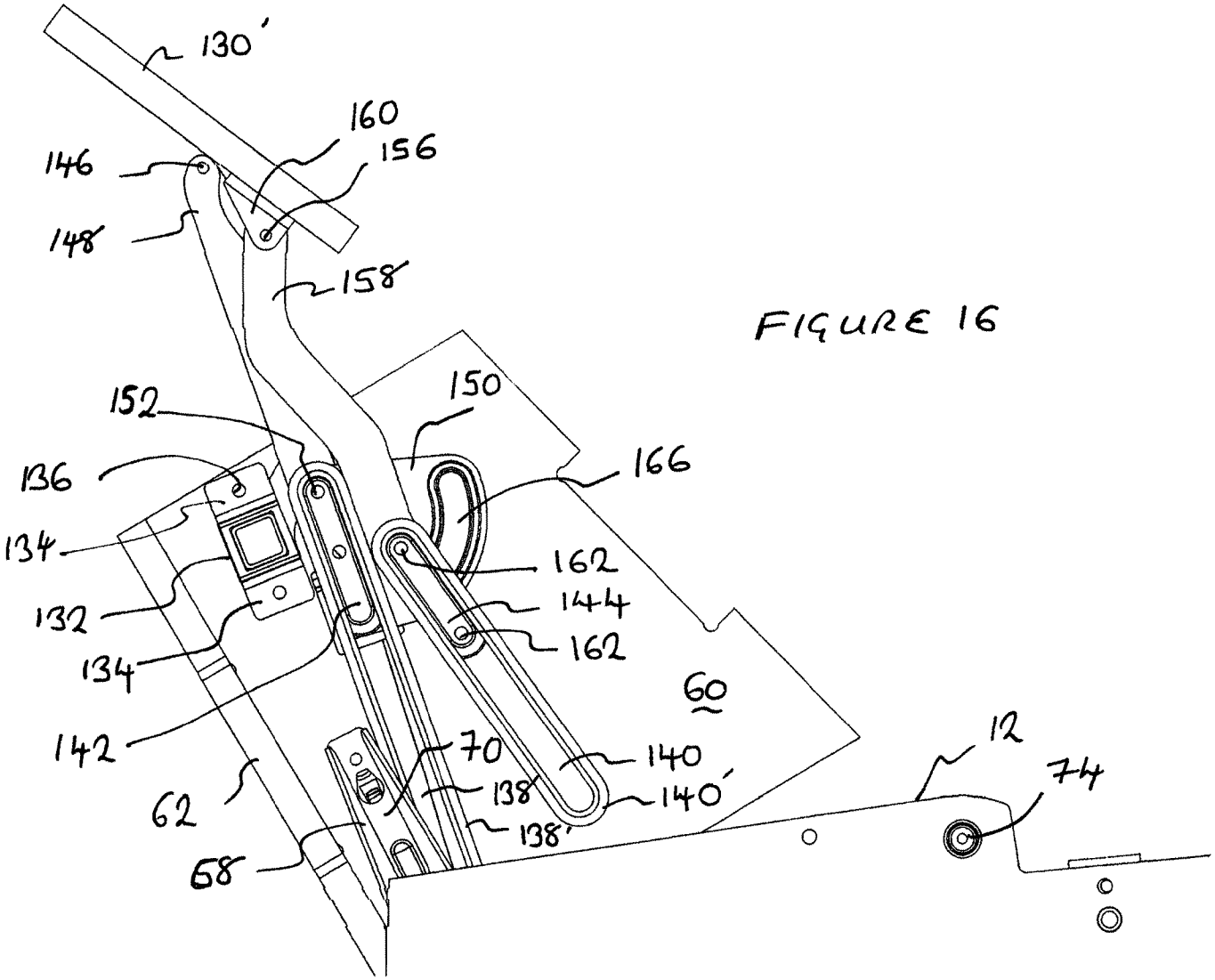
FIG. 16 is an enlarged side view similar to FIG. 15 of the backrest and headrest area of the chair of FIG. 1, with a side panel of the backrest omitted from the drawing, as in FIG. 14.

In the perspective view of FIG. 6 and the side view of FIG. 7 it will be understood that various components of the structural frame and operating mechanism of the chair are omitted from the drawings. This is for the purpose of illustration only as will become apparent from the description that follows. In FIGS. 6 and 7, for example, the lateral left hand side panel 12 and the footrest arrangement 14, shown in FIGS. 1-5, have been removed to reveal the detail arrangement of the internal parts of the chair.

Referring to the drawings, a support and operating mechanism 10 for an adjustable recliner chair comprises a footrest 14, a base support 16, an intermediate support 18, and a backrest or back support 20. The base support 16 constitutes the floor standing part of the chair and comprises a pair of parallel lateral chassis legs in the form of L-Section elongate members 22 which extend on the lateral (left and right hand) sides of the chair. The chassis legs are preferably of metal construction, more preferably pressed steel, and are connected together at the front and rear of the chair by front and rear L-section cross-members 24 and 26, also of metal construction. The chassis legs 22 and cross-members 24, 26 constitute floor support members on which castors or the like may be attached for contact with the floor on which the chair stands.

The chassis legs 22 each carry a pair of upstanding members including a generally triangular shape upstanding member 28 positioned towards the front of the chair and an upstanding member 30 positioned between the mid-point and rear of the chair. The upstanding member 30 also has a generally triangular configuration. In the illustrated embodiment upstanding members 28 and 30 are constructed of metal, preferably steel, and are joined to the respective chassis legs 22 by welding or suitable fixing means such as bolts, screws or the like. A roller in the form of a bearing 32 is mounted at the distal end or apex of the upstanding member 28. The bearing 32 is mounted on the outward facing side of the upstanding member 28. The upstanding member 30 carries a roller in the form of a bearing 34 partway along its length between the chassis rail and its distal end. The bearing 34 is mounted on the outward facing side of the upstanding member 30 such that it lies in the same plane as the bearing 32 for engagement in respective raceway slots 36 and 38 provided in the lateral side panels 12 at appropriate spaced apart locations.

The slots 36 and 38 are provided with correspondingly shaped inserts, preferably of a hard wearing plastics material such as nylon or glass reinforced nylon, and fit into the correspondingly shaped slots 36 and 38 in the respective lateral side panels 12 of the intermediate support 18. The slots 36 and 38 are inclined with respect to the bottom edge 40 of the respective side panels, such that movement of the side panels in a forward direction of the chair, as indicted in the direction 42 in FIG. 1, results in the forward movement of the side panels, with respect to the base support section 16, having an upward component which raises the bottom edge 40 of the side panels upwards with respect to the chassis legs which lie parallel to the side panels 12 for supporting the chair on the floor on which it stands.

The rear upstanding members 30 are each provided with a perpendicular tab 44 on the inward facing side thereof. The tabs 44 provide a connection point for a further cross-member 46, as best shown in FIG. 1, which is preferably constructed of metal and connected to the respective tabs by bolts, screws of other fixing means. The cross-member 46 stiffens the upper region of the upstanding members 30 linking them together for further rigidity of the base support structure 16. The distal ends of the upstanding members 30 carry a further roller in the form of a bearing 48. The bearing 48 is located in a plane off-set from the plane of the bearings 32 and 34, that is to say offset inwards towards the interior of the chair. This is achieved by means of a slight crank or step in the upstanding support 30 between the position of the two bearings carried by the support 30, namely bearings 34 and 48. In this way bearing 48 is positioned in a plane offset slightly towards the interior region of the chair. The reason for this offset will become apparent from the description that is to follow.

The lateral side panels 12 constitute part of the intermediate support structure 18 of the chair, which intermediate support structure is moveable relative to the base structure by a guide arrangement which includes the bearings 32, 34 and respective slots 36 and 38, as previously described. In the context of the present invention the bearings 32, 34 and corresponding slots 36, 38 in the respective side panels 12 constitute first guide means for determining the movement of the intermediate support with respect to the stationary base support, that is to say fore and aft, with a slight upwards component in the forward direction and a corresponding downwards component in the rearward direction as previously indicated.

As previously mentioned, the left hand side panel 12 shown in FIG. 6 has been removed from the view of the support and operating mechanism of the chair. However, it is to be understood that the respective lateral side panels 12 are connected together to form a rigid structure by means of a cross member 50 towards the rear of the chair, a cross member 51 at a mid-point along the side panels 12 and a generally rectangular seat frame (not shown) which extends substantially along the length of the respective side panels and is fixed to the panels at a plurality of locations, as can be seen in FIG. 1, by means of L-shape fixing brackets 54 on the inward facing surface of the side panels 12 at the top edge 55 thereof.

The seat frame preferably comprises an outer rectangular frame, preferably of metal such as steel but embodiments are also contemplated in which the seat or frame is a wood or MDF structure. The seat frame supports the seat and seat cushion (not shown) of the chair in a manner well known to those skilled in the art. In this respect it will be understood that the seat frame constitutes part of the intermediate support, and being fixed with respect to the lateral side panels 12 moves in the same way as the side panels with respect to the base support. In this way the side panels can carry the arms of the upholstered chair so that they move with the seat as the chair is moved between its upright and reclined positions.

In the illustrated embodiment the recliner chair is powered. The chair 10 is provided with actuator means 100 for moving the intermediate support structure relative to the stationary base. This will be described in more detail below.

The actuator means 100 comprises an electrical linear actuator 102 of the Beta Drive™ type available from Derwert-Okin having a reversible motor 104, a movable component block 106 and a fixed stationary component 108 in the form of a rail or track on which the movable part 106 is mounted. The actuator 102 is fixed at one end to the cross member 24 at the front of the chair and at the other end to the cross member 26 towards the rear of the chair. The Actuator 102 is orientated such that the guide rail extends parallel with the chassis legs 22. The movable part or block 106 is mounted on the fixed guide rail 108. Actuation of the actuator 102 effects translational movement of the movable part 106 along the guide rail 108 in a backwards and forwards direction depending on the direction of the reversible motor.

A U-shape bracket 110 is fixably mounted atop the movable part 106. A roller 112 in the form of a bearing is rotatably mounted on a pin 114 between the sides of the U-shape bracket, at a top corner position of the bracket 110 at a rearward end thereof. The roller 112 is received within a guide slot 116 in a substantially planar bracket 118 which is fixed in relation to the cross member 51 by means of a U-shape bracket 120 fixed mid-way along the cross-member 51. The bracket 118 has a lip or flange 121 along its upper surface which locates the bracket against the lower surface of the cross member 51. The flat face of the bracket 118, i.e. the side opposite the lip 121, locates against the flat face of the U-shape bracket 120. The cross member 51, brackets 118 and 120 are of metal construction and are preferably joined together by welding.

The actuator 102, bracket 110, guide slot bracket 118 and roller 112 constitute actuator means for adjusting the configuration of the chair.

As can best be seen in the drawing of FIG. 7, the guide slot 116 includes a first linear section 122 and a second linear section 124, with the first linear section 122 inclined with respect to the second linear section. The second liner section 124 extends in the direction of the chassis legs 22 and parallel thereto, i.e. horizontally in the normal orientation of the chair. The first linear section 122 is inclined relative to the second section 124 by an amount substantially equal and opposite to the inclination of the guide slots 36 and 38. The length of the first linear section 122 is also substantially equal to the length of the slots 36 and 38. This geometry ensures that the roller 112 in the guide slot 116 is free to move along the slot as the seat section 18 is moved fore and aft by the actuator 102 relative to the base support section 16. Adjustment of the chair by the actuator 102 will be explained further in the description to follow.

Thus, it will be appreciated that the guide slot 116 defines a guide cam and the roller 112 a follower of the actuator means of the illustrated embodiment, where the roller 112 follows the profile of the slot as the actuator 102 moves the movable block 106 along the guide track 108.

The U-shape bracket 110 is further provided with a second pin 126 at a lower rearward corner of the bracket. One end of a flexible force transmitting connecting line, in this embodiment a belt or strap 128, is attached to the pin 126 and thereby is fixedly secured to the movable part 106 of the actuator 102. The strap 128 comprises part of a hoist arrangement for moving a head or neck rest 130 at the upper end of the backrest 20, as described in greater detail below.

The back support 20 comprises a generally rectangular box type frame 58 having a pair of lateral side panels 60 connected by front and rear panels. In the drawings only the rear panel 62 is shown, the front panel is omitted from the drawings to show the interior arrangement of the hoist for the head or neck rest 130.

The box frame backrest structure 58 is preferably constructed from MDF or other board like material with metal brackets 68 attached to the outward facing lateral sides towards the lower end of the backrest so that the backrest 58 can be slid on and off correspondingly shaped connectors 70 at the distal end of a pair of arcuate lever arms 72. The lever arms 72 are provided on both sides of the chair and pivotally connect the backrest to the respective lateral side panels 12 by means of a pivot pin 74 at the opposite end of the lever arm to the connector 70. The pivot pins 74 on the respective left and right hand side levers 72 define the pivot axis of the backrest which is pivotally mounted in relation to the intermediate support by the pivot pins. Movement of the backrest about its pivot axis in constrained by a second guide means arrangement comprising the respective roller bearings 48 which run in respective U-shape guide channels 76 which have their open side on the inward facing side of the respective lever arms 72, that is to say on the side of the lever arm that faces the interior of the chair. The guide channels 76 are provided along an intermediate section of the levers between the pivot point 74 and connector 70 and are formed with a U-shape cross section such that the roller 48 engages the upper lip or wall 80 of the U-section. Engagement of the roller bearings 48 with the respective upper lip part 80 of the U-shape cross section ensures that the seat back is supported by the pivot pins 74 and the actuator 102. The weight of the backrest is supported in part by the reaction at the bearings 48 with the upper engaging lip or wall 80 of the slots 76.

In this respect it will be understood that the turning moment due by the weight of the back support including the backrest frame and seat cushion etc, and the weight of an occupant's upper body, is reacted at the bearing 48 by an equal and opposite moment due to the reaction force generated at the bearing 48 and carried by the base support structure. It is to be understood that the geometric relationship between the position of the various bearings 32, 34 and 48, the position of the pivot 74, the position and inclination of the slots 36 and 38 and the shape of the guide 76, in particular the upper lip surface which engages the bearing 48, is such that pivotal movement of the backrest is directly connected to movement of the intermediate support.

Thus, movement of the intermediate support section 18, which includes the seat, is coordinated at all times with movement of the backrest to ensure a natural progression between the different positions of the chair. Pivotal movement of the backrest about its pivot axis is constrained in part by the inter-engagement of the bearings 48 and the respective guide surfaces 80, such that as the support arms 72 rotate the bearings 48 follow the cam guide surfaces 80 of the support arms which generates a reaction force at the pivot pins 74 which constrains the backrest and intermediate support to move relative to the base in the linear direction of the guide slots 36, 38.

Figure 2:
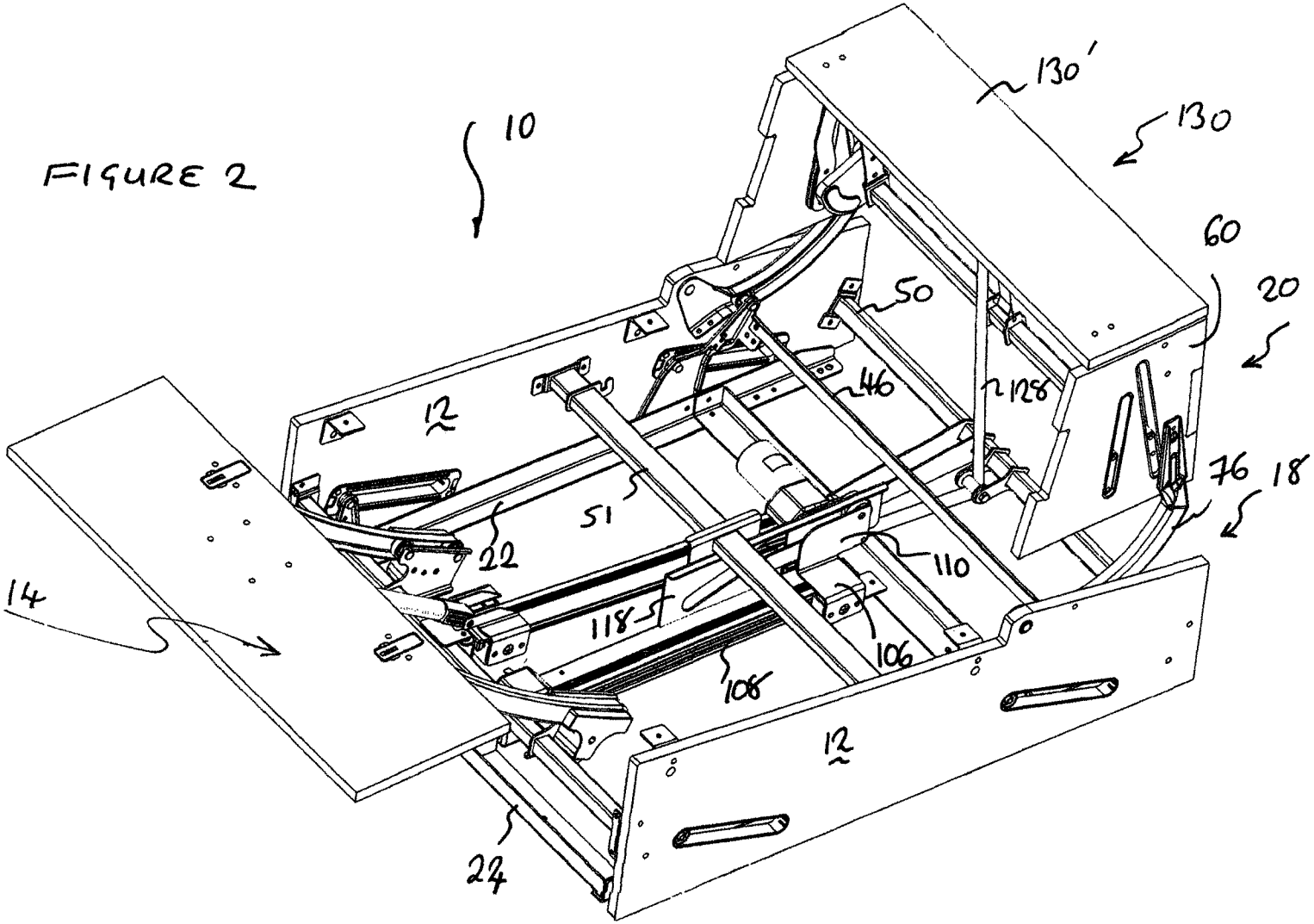
FIG. 2 is a view of the frame and operating mechanism of the chair of FIG. 1 with a footrest board of the chair in an extended position.
Figure 3:
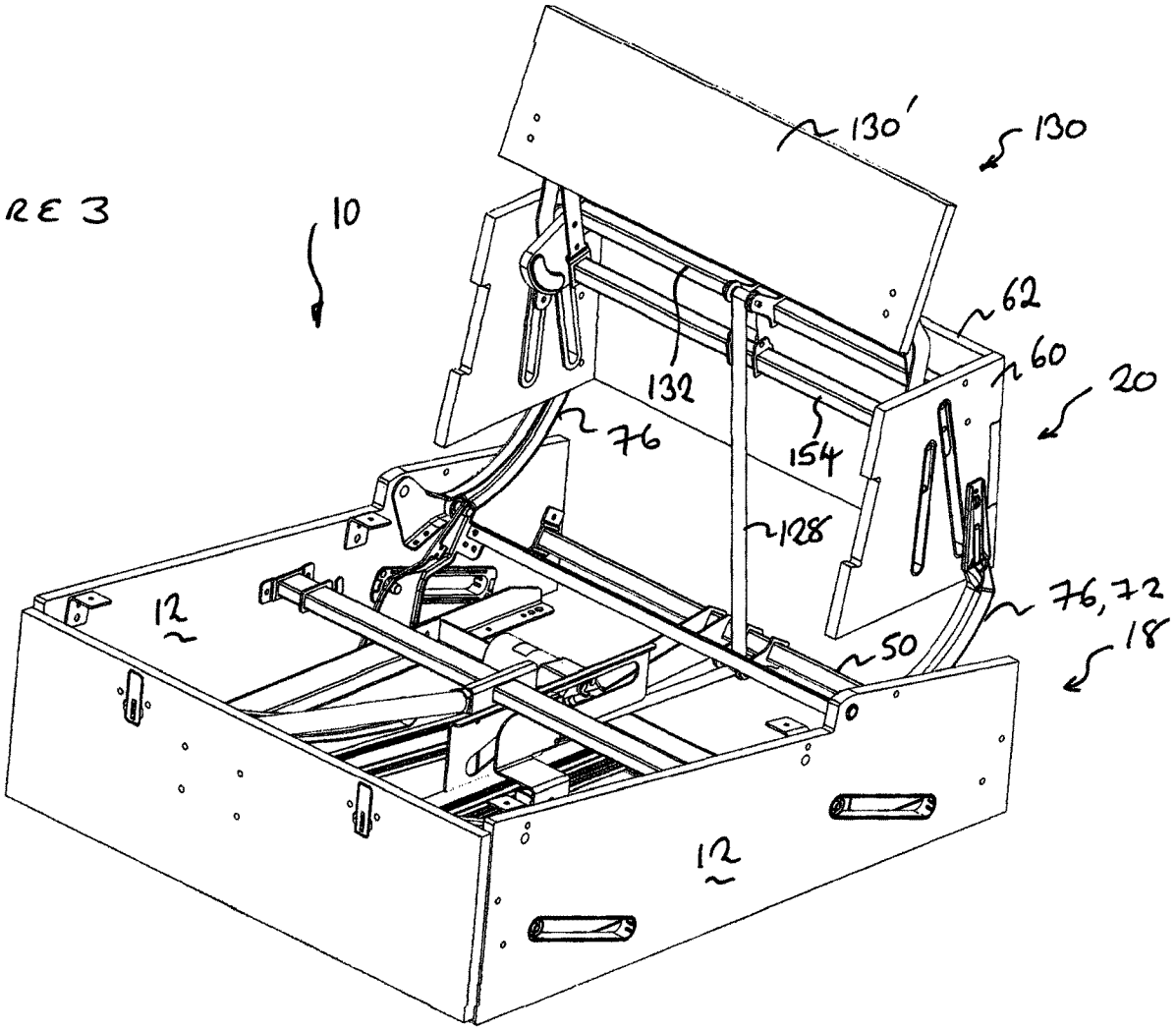
FIG. 3 is a view of the frame and operating mechanism of the chair of FIG. 1 with a headrest board of the chair in a raised position.
Figure 4:
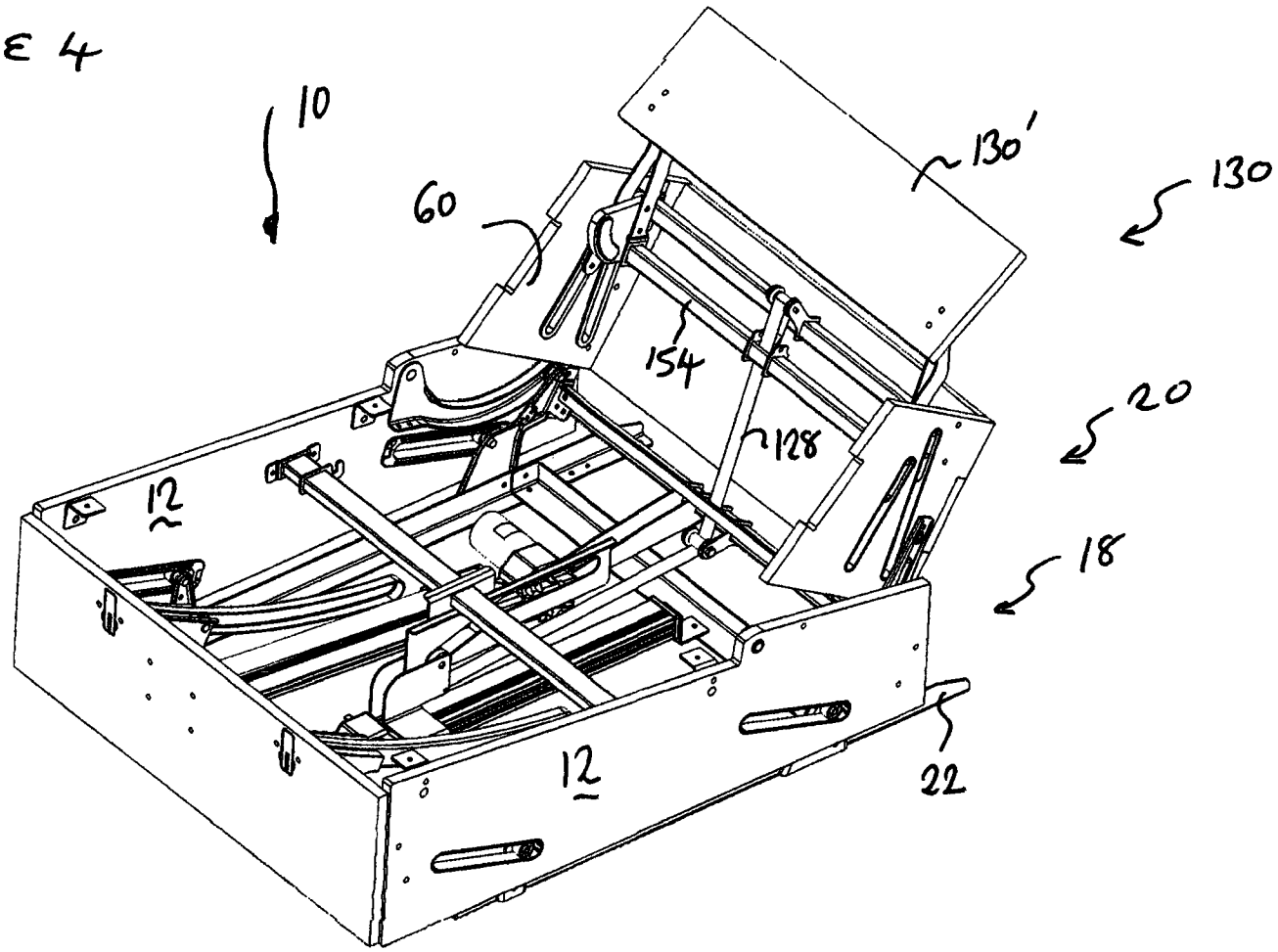
FIG. 4 is a view of the frame and operating mechanism of the chair of FIG. 1 with the headrest raised, as in FIG. 3, and the backrest of the chair in a reclined position.

It will be understood that when the actuator 102 is energised to move the chair from its upright position of FIGS. 1, 2 and 3 to the reclined position of FIGS. 4 and 5, the actuator moves the bearing 112 forward from a transition position 123 in the slot 116, between the first and second linear sections, towards the forward end of the slot, that is to say by moving the block 106 towards the forward end of the chair. A component of the reaction force generated at the bearing 112 causes the intermediate support to move upwards and forwards with respect to the base support as previously described. The bearing 112 effectively pulls the intermediate support and the backrest forward by its engagement with the inclined part of the slot 116. Simultaneously, a component of the reaction force generated at the bearing 48 causes the backrest to recline as the bearing 48 follows the guide 76.

In this respect it will be appreciated that the occupant's body weight is distributed in a counterbalanced manner on the chair, to the extent that substantially half the occupant's body weight counterbalances the other half during a reclining movement of the backrest, or a reverse movement which returns the chair from a reclined position towards its upright position. In this respect it will be further understood that the pivot axis defined by the pivot pins 74 is preferably positioned at or near to the position of the seated occupant's hips, both for the occupants comfort and to optimise the counter balanced operation of the recliner chair to provide a recliner chair which requires minimum effort on the part of the linear actuator 102 to move the chair between its reclined and upright positions.

The inclined and forward (upwards) movement of the intermediate support when the seat back is reclined gives the chair, according to this embodiment of the present invention, the characteristics of a "zero wall" type of chair, since the pivot point of the seat back moves forward towards the front of the chair and away from any adjacent structure, thus avoiding interference that may otherwise occur if the chair were not constructed with this particular design functionality. It will be understood by those skilled in the art that as the back rest pivots downwards about its pivot axis the position of the fulcrum, as defined by the bearings 48, moves with respect to the pivot axis and the centre of pressure applied to the backrest by the seated occupant's body weight when the backrest moves during reclining.

The lateral side panels 60 of the of the backrest are further connected together by means of a tubular metal cross member 132 orthogonal to the side panels and positioned towards the rear panel 62 as can best be seen with reference to FIG. 6. The ends of the cross member are provided with mounting flanges 134 (best seen in FIG. 16) which abut the interior facing surfaces of the respective side panels 60 and are attached thereto by means of suitable fixing means such as screws bolts or the like 136.

As best shown in FIGS. 13 to 16, a pair of elongate linear guide slots 138, 140 are provided in each of the side panels 60. The guide slots 138, 140 are provided with respective wear resistant inserts 138' and 140', for example of nylon or like hard wearing material, and receive respective elongate followers 142 and 144 therein. The followers 142, 144 are slideable in and along the respective guide slots along the length of the slots in the linear direction of the slots.

A first of the slots 138 is inclined in a forward an upward direction, from the vertical, as defined by the rear panel 62 in the upright configuration of the chair, and extends substantially from one end of the panel 60 to the other, that is to say from top to bottom when the backrest is upright. The second guide slot 140 is inclined slightly rearwards such that the slots 138, 140 converge towards each other in the upwards direction of the side panels, again that is say, with the backrest upright. The second guide slot 140 has a smaller lengthwise dimension than the first guide slot 138 so that a minimum separation is maintained between the converging ends of the slots.

The slots 138, 140 and respective followers 142, 144 constitute part of guide means between the backrest 20 and the headrest 130 for rotating the headrest with respect to the backrest as the headrest moves between its raised and lowered positions. Slideable follower 142 is pivotally connected to the headrest panel 130" at pivot 146 via an elongate link element or stay 148 and a guide block 150. The guide block is preferably of moulded plastic construction and is integrally moulded with the follower 142. The link element 148 is pivotally connected at one end to the headrest panel at 146 by means of a pin or the like, and fixedly connected at its other end to the to the guide block 150 at fixing points 152 and the respective end of cross member 154 which extends between the link elements 148 on both sides of the backrest. The cross member 154 is of metal tubular construction and is connected by welding of other suitable means to the ends of respective link elements 148.

The slideable follower 144 is pivotally connected to the headrest panel 130' at pivot 156 via an elongate sinuous W-shape link element or stay 158. Link element 158 is pivotally connected at one end to the headrest panel 130' at 156' by means of a pin or the like on a mounting bracket 160 on the underside of the headrest panel. The link element 158 is fixedly connected at its other end to follower 144 at fixing points 162. A pin (not shown) is provided on the on the link element 158 in the region of the follower 144 between fixing points 162 on its inward facing side. The pin is received in a circumferential slot 166 in the guide block 150 so that the pin follows the guide slot as the follower 144 moves within the slot 140 as the headrest panel is raised and lowered. It will be understood that the pin and guide slot 166 are necessary to maintain the spatial relationship of the respective followers 142, 144 as the followers converge and diverge as they move up and down the respective guide slots 138, 140 during adjustment of the headrest. Thus, the headrest guide means further comprises a third guide, in the form of the slot 166, between the followers 142, 144 of the first and second guides for maintaining a pre-determined spatial relationship between the first and second guide followers 142, 144 as the headrest is moved. Link elements 148 and 158 which constitute headrest stay elements in the illustrated embodiment are preferably of metal sheet construction.

Thus, in the illustrated embodiment the headrest guide means includes first and second guides 138, 140, with each guide being associated with the backrest and each follower 142, 144 associated with the headrest. However, the present invention contemplates embodiments where the followers are associated with the backrest and the guides associated with the headrest.

The first and second guides 138, 140 are inclined with respect to each other such that a turning moment is generated on the headrest when the headrest is raised or lowered.

It will be understood that the longitudinal travel of the follower 142 in the guide slot 138, is greater than the distance moved by the second follower 144 in the guide slot 140. This causes the headrest panel 130' to pivot and tilt forward when it is raised so that it moves from a substantially horizontal position when in its lowered position, on the non-reclined backrest, to a raised and forward tilted position when raised. The followers 142, 144 of the first and second guide slots are connected to respective fore and aft pivotal connections on the headrest panel, and therefore as the headrest is raised or lowered differential movement of the followers in the direction of first guide slot 138 causes the headrest to rotate.

Movement of the headrest panel 130" is effected by the actuator means 100 including the strap 128 which constitutes part of a hoist arrangement which is operative to raise and lower the cross member 152 with respect to the backrest side panels 60. As previously mentioned the hoist comprises part of the actuator means and includes the strap 128 which is connected at one end to the U-shape mounting bracket 110 by means of pin 126. The other end of the strap 128 is connected to a pin 168 mounted on a clevis bracket 170 fixedly connected to a cross member 154 at a mid-point along its length between the respective side panels 60. Between the pins 126 and 168 the strap 128 passes over a series of rollers or pins. From the pin end 126 the strap extends rearward and passed under a roller or pin 171 mounted on a clevis bracket 172 fixed to the cross member 50 at a mid-point along its length. The strap turns through approximately 90 degrees as it passes over the pin 171 from where it extends upwards until it passes over a second pin or roller 174 mounted on a clevis bracket 176 fixed to the cross member 132 at a mid-point along its length, at which point the strap turns through 180 degrees or so until it connects with the pin 168.

The strap is maintained under tension, or with substantially little slack, when the headrest is its lowered position. In this position the actuator 102 is positioned with the movable block 106 fully rearward and the follower 112 positioned at the end of the non-inclined section 124 of the slot 116, that is to say at its rearward extent of travel along the slot 116. Thus, as the actuator is energised to move the movable block 106 forward the follower 112 moves along the linear section 124 of the slot. The pin 126 moves forward with the block 106, which movement causes the strap to hoist the cross member 154 upwards and thereby raise the headrest panel in the manner previously described. The headrest reaches its fully raised position when the follower 112 is moved to the transition point 123 in the guide slot 116 between the respective linear sections, that is to say, between the horizontal section and the inclined section of the slot. At this position the followers 142, 144 reach the end positions in the respective slots 138, 140, where the followers abut the respective ends of the slots. Thus, further movement of the headrest panel with respect to the headrest panel is prevented. However, further forward movement of the actuator block 106 now causes the backrest to recline as the follower 112 now engages with the inclined section 122 of the guide slot 116, and thereby applies a force to the intermediate section of the chair, via the cross-member 51 to drive the intermediate section forward relative to the base support section. As previously described, movement of the backrest occurs at the same time as the intermediate section and therefore the continued forward movement of the actuator block 106 causes the backrest to recline. The backrest reaches it full reclined state when the follower 112 reaches the end of the inclined part of the slot. Thus, the actuator has a first range of movement for pivotally moving the headrest section with respect to the backrest section, and a second range of movement for pivotally moving the backrest with respect to a seat section to provide the backrest with a recliner function. The first and second ranges of movement are contiguous, that is to say, one follows the other with a transition point in between. Thus, movement of the actuator in said second range of movement causes the backrest to move with respect to the seat section without further movement of the headrest section with respect to the backrest section. In this way the headrest may be raised without reclining the backrest but the backrest may only be moved with the headrest raised.

In a recliner chair according to the illustrated embodiment the footrest 14 can be operated independently of the recliner part of the chair, such that the footrest board can be deployed from its retracted vertical position to a substantially horizontal position independently of the reclining movement of the chair. This configuration is often referred to as the "TV position". In the illustrated embodiment an additional electrical linear actuator is provided to drive the footrest outwards to its deployed position so that the chair adopts the "TV position.

The invention claimed is:

1. An article of adjustable furniture, comprising:

a floor standing base section;

an adjustable seat section;

an adjustable backrest section;

a headrest section;

a single actuator for moving said backrest and headrest sections;

wherein:

the seat section is movably mounted with respect to the base section;

the backrest being movably mounted with respect to the seat section; and the headrest is movably mounted with respect to the backrest section, said single actuator effecting coordinated and independent movement of the adjustable backrest and headrest sections relative to one another for selectively altering the configuration of said article of furniture.

2. The article of adjustable furniture, as claimed in claim 1, wherein:

the actuator has a first range of movement for moving the headrest section with respect to the backrest section, and a second range of movement for moving the backrest section with respect to the seat section to provide a recline function, the first and second ranges of movement being different.

3. The article of adjustable furniture, as claimed in claim 2, wherein:

said first and second ranges of movement are contiguous.

4. The article of adjustable furniture, as claimed in claim 2, wherein:

a movement of the actuator means in said first range of movement exclusively moves the headrest with respect to the backrest section.

5. The article of adjustable furniture, as claimed in claim 2, wherein:

a movement of the actuator in said second range of movement causes the backrest to move with respect to the seat section without further movement of the headrest section with respect to the backrest section.

6. The article of adjustable furniture, as claimed in claim 2, further comprising:

at least one connecting line having a first end fixed in relation to a movable part of the actuator and a second end fixed in relation to the headrest section, whereby movement of said actuator is transmitted to said headrest via said connecting line.

7. The article of adjustable furniture, as claimed in claim 6, wherein:

said connecting line comprises one of a group consisting of a belt, a strap, a cable, a cord, and a rope.

8. The article of adjustable furniture, as claimed in claim 2, further comprising:

a guide cam associated with one of said seat section and said actuator means and a follower associated with the other of said seat section and said actuator means.

9. The article of adjustable furniture, as claimed in claim 8 wherein:

said guide cam is fixed in relation to the seat section and said follower is fixed in relation to a movable part of said actuator means.

10. The article of adjustable furniture, as claimed in claim 8, wherein:

said guide cam has a cam profile including a first linear section which defines said first range of movement of said actuator means and a second linear section inclined with respect to said first section which defines said second range of movement.

11. The article of adjustable furniture, as claimed in claim 10, wherein:

the cam profile is such that said follower is free to move back and forth in said first section to effect movement of said headrest, movement of said follower in the said second section being constrained by engagement of said follower and the inclined section, which engagement imparts a reaction force between the follower and the inclined section to effect movement of the seat section with respect to the base section and the backrest section with respect to the seat section.

12. The article of adjustable furniture, as claimed in claim 11, wherein:

said follower is mounted in relation to said movable part of said actuator.

13. The article of adjustable furniture, as claimed in claim 1, wherein:

guide means are provided between the seat section and the base section for guided movement of the seat section relative to the base section when the backrest section moves about its pivot axis.

14. The article of adjustable furniture, as claimed in claim 13, wherein:

the seat section includes a pair of lateral side panels, and wherein guides of said guide means are provided in or on said side panels.

15. The article of adjustable furniture, as claimed in claim 14, wherein:

said guides are provided as respective slots in said side panels.

16. The article of adjustable furniture, as claimed in claim 13, further comprising:

a guide cam associated with one of said seat section and said actuator means;

said guide cam has a cam profile including a first linear section which defines said first range of movement of said actuator means and a second linear section inclined with respect to said first section which defines said second range of movement; and wherein guides of said guide means is/are inclined in an equal and opposite direction to the inclination of the said second linear section of said cam profile.

17. The article of adjustable furniture, as claimed in claim 1, wherein:

the seat section moves in a forwards and upwards direction when the backrest is reclined, and in a rearwards and downwards direction when the backrest is raised.

18. The article of adjustable furniture, as claimed in claim 1, wherein:

the backrest section is guided for movement relative to the seat section by further guide means including at least one guide associated with one of the seat section and the backrest section and at least one follower associated with the other of the seat section and the back rest section.

19. The article of adjustable furniture, as claimed in claim 1, wherein:

the article of adjustable furniture is a chair.

20. The article of adjustable furniture, as claimed in claim 1, wherein:

said actuator means is arranged to move the headrest between raised and lowered positions, and further comprising guide means arranged between the headrest and the backrest for rotating the headrest with respect to the backrest as the headrest moves between said raised and lowered positions.

21. The article of adjustable furniture, as claimed in claim 11, further comprising:

at least one connecting line having a first end fixed in relation to a movable part of the actuator and a second end fixed in relation to the headrest section, whereby movement of said actuator is transmitted to said headrest via said connecting line; and said follower is mounted in relation to said movable part of said actuator.

22. An article of adjustable furniture, comprising:

a floor standing base section, adjustable seat, backrest and headrest sections and actuator means for moving said backrest and headrest sections, the seat section being movably mounted with respect to the base section, the backrest being movably mounted with respect to the seat section and the headrest being movably mounted with respect to the backrest section, characterized in that said actuator means includes a single actuator for co-ordinated movement of the adjustable backrest and headrest sections for selectively altering the configuration of said article of furniture;

the actuator has a first range of movement for moving the headrest section with respect to the backrest section, and a second range of movement for moving the backrest with respect to the seat section to provide a recline function;

a guide cam associated with one of said seat section and said actuator means and a follower associated with the other of said seat section and said actuator means; and said guide cam is fixed in relation to the seat section and said follower is fixed in relation to a movable part of said actuator means.

23. The article of adjustable furniture, as claimed in claim 22, wherein:

a movement of the actuator means in said first range of movement exclusively moves the headrest with respect to the backrest section.

24. The article of adjustable furniture, as claimed in claim 22, wherein:

a movement of the actuator in said second range of movement causes the backrest to move with respect to the seat section without further movement of the headrest section with respect to the backrest section.

25. The article of adjustable furniture, as claimed in claim 22, further comprising:

at least one connecting line having a first end fixed in relation to a movable part of the actuator and a second end fixed in relation to the headrest section, whereby movement of said actuator is transmitted to said headrest via said connecting line.

26. The article of adjustable furniture, as claimed in claim 25, wherein:

said connecting line comprises one of a group consisting of a belt, a strap, a cable, a cord, and a rope.

27. The article of adjustable furniture, as claimed in claim 22, wherein:

the seat section moves in a forwards and upwards direction when the backrest is reclined, and in a rearwards and downwards direction when the backrest is raised.

28. The article of adjustable furniture, as claimed in claim 22, wherein:

the backrest section is guided for movement relative to the seat section by further guide means including at least one guide associated with one of the seat section and the backrest section and at least one follower associated with the other of the seat section and the back rest section.

29. The article of adjustable furniture, as claimed in claim 22, wherein:

said actuator means is arranged to move the headrest between raised and lowered positions, and further comprising guide means arranged between the headrest and the backrest for rotating the headrest with respect to the backrest as the headrest moves between said raised and lowered positions.

30. An article of adjustable furniture, comprising:

a floor standing base section, adjustable seat, backrest and headrest sections and actuator means for moving said backrest and headrest sections, the seat section being movably mounted with respect to the base section, the backrest being movably mounted with respect to the seat section and the headrest being movably mounted with respect to the backrest section, characterized in that said actuator means includes a single actuator for co-ordinated movement of the adjustable backrest and headrest sections for selectively altering the configuration of said article of furniture;

the actuator has a first range of movement for moving the headrest section with respect to the backrest section, and a second range of movement for moving the backrest with respect to the seat section to provide a recline function;

a guide cam associated with one of said seat section and said actuator means and a follower associated with the other of said seat section and said actuator means; and said guide cam has a cam profile including a first linear section which defines said first range of movement of said actuator means and a second linear section inclined with respect to said first section which defines said second range of movement.

31. The article of adjustable furniture, as claimed in claim 30, wherein:

the cam profile is such that said follower is free to move back and forth in said first section to effect movement of said headrest, movement of said follower in the said second section being constrained by engagement of said follower and the inclined section, which engagement imparts a reaction force between the follower and the inclined section to effect movement of the seat section with respect to the base section and the backrest section with respect to the seat section.

32. The article of adjustable furniture, as claimed in claim 30, wherein:

said follower is mounted in relation to said movable part of said actuator.

33. The article of adjustable furniture, as claimed in claim 30, further comprising:

at least one connecting line having a first end fixed in relation to a movable part of the actuator and a second end fixed in relation to the headrest section, whereby movement of said actuator is transmitted to said headrest via said connecting line; and said follower is mounted in relation to said movable part of said actuator.

34. An article of adjustable furniture, comprising:

a floor standing base section, adjustable seat, backrest and headrest sections and actuator means for moving said backrest and headrest sections, the seat section being movably mounted with respect to the base section, the backrest being movably mounted with respect to the seat section and the headrest being movably mounted with respect to the backrest section, characterized in that said actuator means includes a single actuator for co-ordinated movement of the adjustable backrest and headrest sections for selectively altering the configuration of said article of furniture;

guide means are provided between the seat section and the base section for guided movement of the seat section relative to the base section when the backrest section moves about its pivot axis;

a guide cam associated with one of said seat section and said actuator means;

said guide cam has a cam profile including a first linear section which defines said first range of movement of said actuator means and a second linear section inclined with respect to said first section which defines said second range of movement; and wherein guides of said guide means is/are inclined in an equal and opposite direction to the inclination of the said second linear section of said cam profile.

35. The article of adjustable furniture, as claimed in claim 34, wherein:

the seat section includes a pair of lateral side panels, and wherein guides of said guide means are provided in or on said side panels.

36. The article of adjustable furniture, as claimed in claim 34, wherein:

said guides are provided as respective slots in said side panels.

37. An article of adjustable furniture, comprising:

a floor standing base section, adjustable seat, backrest and headrest sections and a single actuator for moving said backrest and headrest sections;

the seat section being movably mounted with respect to the base section;

the backrest being movably mounted with respect to the seat section and the headrest being movably mounted with respect to the backrest section; and wherein said single actuator means effects an independent and a co-ordinated movement of the adjustable backrest and headrest sections relative to one another for selectively altering the configuration of said article of furniture.

38. An article of adjustable furniture, comprising:

a floor standing base;

an adjustable seat;

a backrest section, the adjustable seat being movably mounted with respect to the backrest section;

a headrest section, the headrest section being movably mounted with respect to the backrest section;

an actuator configured to move the backrest section and the headrest section, the actuator including a single actuator for coordinated independent movement of the backrest section with respect to the headrest section;

wherein the actuator has a first range of movement for moving the headrest section with respect to the backrest section and a second range of movement for moving the backrest section with respect to the seat section to provide a recline function, the first and second ranges of movement being different; and wherein a movement of the actuator means in said first range of movement exclusively moves the headrest with respect to the backrest section.

39. An article of adjustable furniture, comprising:

a floor standing base;

an adjustable seat;

a backrest section, the adjustable seat being movably mounted with respect to the backrest section;

a headrest section, the headrest section being movably mounted with respect to the backrest section;

an actuator configured to move the backrest section and the headrest section, the actuator including a single actuator for coordinated independent movement of the backrest section with respect to the headrest section;

wherein the actuator has a first range of movement for moving the headrest section with respect to the backrest section and a second range of movement for moving the backrest section with respect to the seat section to provide a recline function, the first and second ranges of movement being different; and wherein a movement of the actuator in said second range of movement causes the backrest to move with respect to the seat section without further movement of the headrest section with respect to the backrest section.

* * * * *